US006087574A

United States Patent [19]

Kitashima et al.

[11] Patent Number: 6,087,574

[45] Date of Patent: Jul. 11, 2000

[54] ELECTRONIC PIANO

[75] Inventors: Riichi Kitashima, Shizuoka-ken; Muneo Ishida, Hamamatsu; Makoto Nakayama, Iwata, all of Japan

[73] Assignee: Kabushiki Kaisha Kawai Gakki Seisakusho, Shizuoka-Ken, Japan

[21] Appl. No.: 08/725,220

[22] Filed: Sep. 26, 1996

[30] Foreign Application Priority Data

| | | | |
|---|---|---|---|
| Sep. 28, 1995 | [JP] | Japan | 7-251028 |
| Oct. 19, 1995 | [JP] | Japan | 7-271220 |
| Jan. 9, 1996 | [JP] | Japan | 8-001589 |
| Jan. 9, 1996 | [JP] | Japan | 8-001591 |

[51] Int. Cl.[7] ..... G10D 13/02

[52] U.S. Cl. ..... 84/423 R

[58] Field of Search ..... 84/423 R, 439, 84/440, 433

[56] References Cited

U.S. PATENT DOCUMENTS

| | | | |
|---|---|---|---|
| 5,386,083 | 1/1995 | Kawamura | 84/419 |
| 5,463,184 | 10/1995 | Kawamura | 84/719 |
| 5,796,023 | 8/1998 | Kumano et al. | 84/433 |
| 5,945,617 | 8/1999 | Niitsuma | 84/423 R |
| 5,949,013 | 9/1999 | Satoshi | 84/719 |

FOREIGN PATENT DOCUMENTS 4347895 7/1999 Japan .

*Primary Examiner*—Robert E. Nappi
*Assistant Examiner*—Kim Lockett
*Attorney, Agent, or Firm*—Davis and Bujold

[57] ABSTRACT

To provide an electronic piano maintaining a compact appearance and providing the key touch equivalent to that of an acoustic piano. A hammer equivalent member is composed of a butt, a L-shaped member and a catcher shank. When the butt is pushed up by a jack responsive to the key depression, the hammer equivalent member starts rotating in a direction reverse to the rotary direction of a depressed key. Subsequently, after the jack leaves the butt, the hammer equivalent member continues to be rotated inertially. By contacting the projection of the L-shaped member of the hammer equivalent member, a stopper stops the inertial movement of the hammer equivalent member. The hammer equivalent member is almost equivalent to the hammer assembly of the usual acoustic piano in inertial moment and the angle formed by the center of gravity relative to a virtual perpendicular passing a center pin. Furthermore, the hammer equivalent member is shorter than the hammer assembly in appearance.

7 Claims, 23 Drawing Sheets

ELECTRONIC PIANO

FIELD OF THE INVENTION

This invention relates to an electronic piano provided with an action simulation mechanism applying an action simulating load to a keyboard, the keyboard for use in the electronic piano and an action simulation hammer secured to a butt composing the electronic piano.

BACKGROUND OF THE INVENTION

Conventionally, an electronic piano emits electronic sound from a loudspeaker in response to a player's depressing or releasing keys. Such electronic sound has been improved, and has recently reached some satisfactory level. However, the key touch of the electronic piano remains significantly different from that of an acoustic upright piano, despite various improvements.

Specifically, an action simulation mechanism has been developed for providing the electronic piano with a key touch similar to that of the acoustic upright piano. For example, Japanese laid-open Patent Application No. 4-347895 discloses the electronic piano, as shown in FIG. 11, incorporating a hammer arm P14 rotatable about a shaft P10 for depressing the rear end of a key P12, and, as shown in FIG. 12, incorporating a hammer arm P20 rotatable about a shaft P16 for pushing up the tip of a key P18.

The key touch of the acoustic upright piano is now generally explained. As shown in FIG. 14, when a player depresses a key 111, a wippen 115 rotates in the direction reverse to the rotary direction of key 111, or counterclockwise as viewed in FIG. 14. A jack 117 rotatably attached to the wippen 115, in turn, rises to push up a hammer butt 118, causing the hammer butt 118 to rotate in the direction reverse to the rotary direction of the key 111, or counterclockwise as viewed in FIG. 14, together with a hammer assembly 120 composed of a hammer shank 121, a hammer head 123 and a hammer felt 122. After the jack 117 rises to a predetermined position, placing a jack tail 117*a* in contact with a regulating button 116, the jack 117 leaves the hammer butt 118. Therefore, the hammer butt 118, the hammer shank 121 and the hammer head 123 are inertially rotated, thereby striking a string.

As aforementioned, in the acoustic upright piano, the wippen 115, the jack 117 and the hammer butt 118 are rotated on the different and respective rotary axes, and the jack 117 leaves the hammer butt 118 at a predetermined timing, providing the complicated touch of the key 111.

In the electronic keyboard provided with the action simulation mechanism as shown in FIGS. 11 and 12, however, the hammer arm and the key are rotated on a single axis, providing a monotonous or simple key touch, different from the acoustic piano.

In appearance, the electronic piano is compact. For example, the height of the frame roof of the electronic piano is slightly higher than the height of the keyboard. When the aforementioned action simulation mechanism is incorporated in the electronic piano, the height is increased. Therefore, it is difficult to attain the advantageous compact structure of the electronic piano.

Especially, as shown in FIG. 13, when the action simulation mechanism equivalent to the action mechanism of the acoustic piano is used, the aforementioned structural problem is remarkable.

The action simulation mechanism is composed of a wippen equivalent member 215, a jack equivalent member 217, a hammer equivalent member 221 and a stopper 232. The hammer equivalent member 221 includes a hammer butt, a hammer shank, a hammer head, a hammer felt, a catcher and a catcher shank. When a player depresses a key, the key is rotated, rotating the wippen equivalent member 215. When the wippen equivalent member 215 is thus rotated in response to the key depression, the jack equivalent member 217 is raised, pushing up the hammer equivalent member 221. The hammer equivalent member 221 is thus rotated, leaves the jack equivalent member 217, is further inertially rotated, and is placed in contact with the stopper 232, to stop. In this action simulation mechanism, unlike the action simulation mechanism shown in FIGS. 11 and 12, the wippen equivalent member 215, the jack equivalent member 217 and the hammer equivalent member 221 are rotated on the different and respective axes, and the jack equivalent member 217 leaves the hammer equivalent member 221 at a predetermined timing, providing a key touch which is similar to that of the acoustic upright piano. However, since the hammer equivalent member 221 has a substantial height, the height of the frame roof of the electronic piano is increased, and the compact appearance of the normal electronic piano cannot be maintained.

SUMMARY OF THE INVENTION

Wherefore, an object of the present invention is to provide an electronic piano having a compact outer configuration and providing a key touch similar to that of an acoustic piano.

Another object of the present invention is to provide a keyboard having a compact outer configuration peculiar to the electronic piano.

Another object of the present invention is to provide an action simulation hammer for an electronic keyboard instrument prevented from deviating from the original positional relationship with a butt.

A further object of the present invention is to provide a simulation action of an electronic keyboard instrument in which a let-off timing can be easily adjusted.

To attain these and other objects, the present invention provides an electronic piano with an action simulation mechanism for applying an action simulating load to a keyboard. The action simulation mechanism is provided with a wippen equivalent member rotated in response to key depression, a jack equivalent member rotatably attached to the wippen equivalent member for rising when the wippen equivalent member is rotated, a hammer equivalent member rotatably attached via a rotation axis to a piano body for being thrust up by the jack equivalent member and rotating while the jack equivalent member is rising to a predetermined position, and leaving the jack equivalent member and inertially rotating after the jack equivalent member reaches the predetermined position, and a stopper for contacting the hammer equivalent member and stopping the inertial movement of the hammer equivalent member. The hammer equivalent member is shorter than the hammer assembly of an acoustic piano, the hammer assembly being provided with a string striking member composed of a hammer felt and a hammer wood, a hammer shank, a hammer butt, and a catcher shank provided with a catcher.

In the electronic piano, when a player depresses the key, the key is rotated, the wippen equivalent member is rotated responsive to the key depression, and the jack equivalent member is accordingly raised. The hammer equivalent member is thrust up by the jack equivalent member and rotated, until the jack equivalent member is raised to the specified position. The hammer equivalent member, in turn, continues to rotate via inertial. Although the hammer equivalent member fails to strike a string, the hammer equivalent member lets off the jack equivalent member at a timing which is similar to that of the hammer assembly of the acoustic upright piano. Therefore, the touch of the keyboard is almost equivalent to that of the acoustic upright piano. Furthermore, since the hammer equivalent member is shorter than the hammer assembly of the acoustic piano, it can be accommodated in the electronic piano having a low frame roof, maintaining a compact appearance.

The inertial moment around an rotary axis and the angle formed by the center of gravity relative to a virtual perpendicular passing the rotary axis of the hammer equivalent member are equivalent to those of the hammer assembly of the normal acoustic piano.

In the electronic piano, the resistance the player feels when depressing the key is equivalent to that of the normal acoustic piano. Therefore, the touch of the keyboard provides the player with both the let-off timing and the weight of the depressed key which are equivalent to those in the normal acoustic piano.

The electronic piano is provided with a rail member extending along the arrangement direction of the keyboard and having a stopper thereon. A hammer rail part for contacting and stopping the hammer equivalent member is opposed to the stopper relative to the rotary center of the hammer equivalent member.

Since the electronic piano separately requires no hammer rail, the manufacture of the electronic piano is facilitated.

The stopper provided on the rail member is preferably shorter than the hammer rail part.

The electronic piano requires the reduced quantity of the material of the stopper. Therefore, the overall weight of the electronic piano is advantageously reduced.

The rail member has an almost circular arc cross section centering on the rotary axis of the hammer equivalent member.

The electronic piano requires the minimum quantity of the material of the rail member. Therefore, the overall weight of the electronic piano is advantageously reduced.

The hammer rail part provided on the rail member has an adjustment member for varying the position where the hammer equivalent member is stopped.

The stopper is provided with an adjustment member for varying the position where the movement of the hammer equivalent member is stopped.

In the electronic piano, when the stop position of the hammer equivalent member is changed with time, the changed position can be adjusted to the original position with the adjustment member including, for example, an adjustment screw or spacer. The adjustment member is preferably provided for each hammer equivalent member for individual adjustment.

The present invention further provides a key for use in an electronic piano provided with an action simulation mechanism for applying an action simulating load to the key. The key is provided with a stepped part at its back end such that the surface height of the back end is lowered. The key is operatively connected to the action simulation mechanism via the stepped part.

The key provided with the stepped part lowers the height of the action simulation mechanism, as compared to a key having no stepped part.

When the key having the stepped part is used in the electronic piano provided with the action simulation mechanism for applying the action simulating load to the key, the compact configuration peculiar to the electronic piano can be advantageously maintained.

Furthermore, the key having the aforementioned stepped part is preferably provided in the electronic piano provided with the action simulation mechanism for applying the action simulating load to the keyboard.

In addition to the provision of the stepped part of the key, the hammer equivalent member is lower than the hammer assembly of the usual acoustic piano. Therefore, the hammer equivalent member can be accommodated in the electronic piano having a low roof height, and the compact configuration peculiar to the electronic piano can be maintained.

The present invention further provides an action simulation hammer fixed to a butt in an action simulation mechanism for applying an action simulating load to a key in an electronic keyboard instrument. The action simulation hammer is provided with a hammer part able to contact a string simulation member, a rest part able to contact a hammer rail simulation member, a pair of butt holding parts opposed to each other at an interval almost the same as the width of the butt for holding the butt therebetween, and an insertion bore for a fastening shaft to pass through for fastening the action simulation hammer to the butt.

When the key is depressed, the action simulation hammer of the action simulation mechanism is operated. The hammer part contacts the string simulation member and returns. Subsequently, the rest part contacts the hammer rail simulation member and stops. The action simulation hammer is fixed to the butt with the fastening shaft through the insertion bore, and the butt is held between the butt holding parts. Therefore, even after the electronic keyboard instrument is played over a long term, the action simulation hammer is prevented from rotating about the fastening shaft. The butt and the action simulation hammer are prevented from changing in their positional relationship. The originally set key touch can remain unchanged.

The hammer part is formed by bending one end of a metal sheet and the rest part is formed by bending the other end of the metal sheet.

The action simulation hammer formed of the hammer part and the rest part can be easily manufactured by the press working of the metal sheet, which is suitable for mass production.

The hammer part is preferably provided with a deadweight.

In the usual acoustic piano the weight or gravity center of the hammer assembly varies with each key. In the action simulation mechanism, by changing the deadweight attached to the hammer part, the weight and gravity center of the action simulation hammer can be adjusted for each key. Therefore, identical action simulation hammers can be used with the deadweight being added to adjust the weight of the gravity center of the action simulation hammer. The configuration is suitable for mass production.

The fastening shaft can be inserted via the deadweight through the insertion bore.

The present invention further provides an action simulation mechanism for applying an action simulating load to a key in an electronic keyboard instrument. The action simulation mechanism is provided with a jack for rising and rotating when the key is depressed and rotated, a butt composed of a hammer part and a catcher part for being pushed up by the jack and rotating while the jack is rising to a predetermined position and for leaving the jack and inertially moving after the jack reaches the predetermined position, a hammer stopper for contacting the hammer part of the butt and stopping the inertial movement of the butt, and a catcher stopper for contacting the catcher part of the butt and stopping the inertial movement of the butt.

The catcher part is projected from the butt toward the front of the electronic keyboard instrument. The rotary angle by which the catcher part is rotated from the initial position until it contacts the catcher stopper is equal to the rotary angle by which the hammer part is rotated from the initial position until it contacts the hammer stopper.

In the action simulation mechanism, when a player depresses the key, the key is rotated, thereby causing the jack to rise. While the jack is rising to the predetermined position, the butt is thrust up and rotated by the jack. After the jack reaches the predetermined position, the butt leaves the jack, inertially moving. In the same manner as in the usual acoustic upright piano, at the predetermined position, after the jack tail of the jack contacts the regulating button, the jack is largely rotated, about the contact part as a fulcrum, and leaves the butt, and the butt continues to rotate via inertia. Afterwards, the hammer part contacts the hammer stopper and at the same time the catcher part contacts the catcher stopper. The timing of the contact of the hammer part coincides with that of the contact of the catcher part because the rotary angle of the catcher part from the initial position to the contact with the catcher stopper is equal to the rotary angle of the hammer part from the initial position to the contact with the hammer stopper.

In the aforementioned action simulation mechanism, the positional relationship of the hammer felt and the string in the acoustic piano corresponds to that of the hammer part and the hammer stopper or that of the catcher part and the catcher stopper. Therefore, if the let-off timing in the acoustic piano is the timing when the predetermined interval p(mm) is reached between the hammer felt and the string, the let-off timing in the action simulation mechanism can be set as the timing when the corresponding predetermined interval p'(mm) is reached between the hammer part and the hammer stopper. If it is difficult to measure the positional relationship between the hammer part and the hammer stopper, the let-off timing can be set as the timing when the corresponding predetermined interval p"(mm) is reached between the catcher part and the catcher stopper. In the same manner as the catcher of the usual acoustic piano, the catcher part of the action simulation mechanism is projected toward the front of the electronic keyboard instrument. Therefore, it is easy to measure the positional relationship between the catcher part and the catcher stopper, and the let-off timing can be easily adjusted.

The action simulation mechanism is also provide with the rail member extended along the arranged keys and covering the hammer part of the butt. The hammer stopper is provided on the rail member, and the rail member is also provided with the hammer rail part opposed to the hammer stopper relative to the rotary center of the butt for contacting the hammer part of the butt at the initial position.

In the action simulation mechanism, since the hammer stopper and the hammer rail part are provided on the rail member, the necessity of a separate hammer rail is obviated, and the structure is simplified. Furthermore, the rail member has, for example, an inverted U-shaped cross-sectional configuration to cover the hammer part, and it is difficult to measure the interval between the hammer part and the hammer stopper. Therefore, by measuring the positional relationship between the catcher part and the catcher stopper, the let-off timing is adjusted.

The rail member is preferably provided with the catcher stopper.

In the action simulation mechanism, in addition to the hammer stopper and the hammer rail part, the catcher stopper is also provided on the rail member. Therefore, no separate catcher stopper is required, and the overall structure of the action simulation mechanism is further simplified.

BRIEF DESCRIPTION OF THE DRAWINGS

The invention will now be described, by way of example, with reference to the drawings, in which:

FIG. 18 is a diagrammatical view of an action simulation hammer provided with a deadweight according to a modification of the third embodiment of the present invention;

DETAILED DESCRIPTION OF THE PREFERRED EMBODIMENTS

First Embodiment

Figure 1:
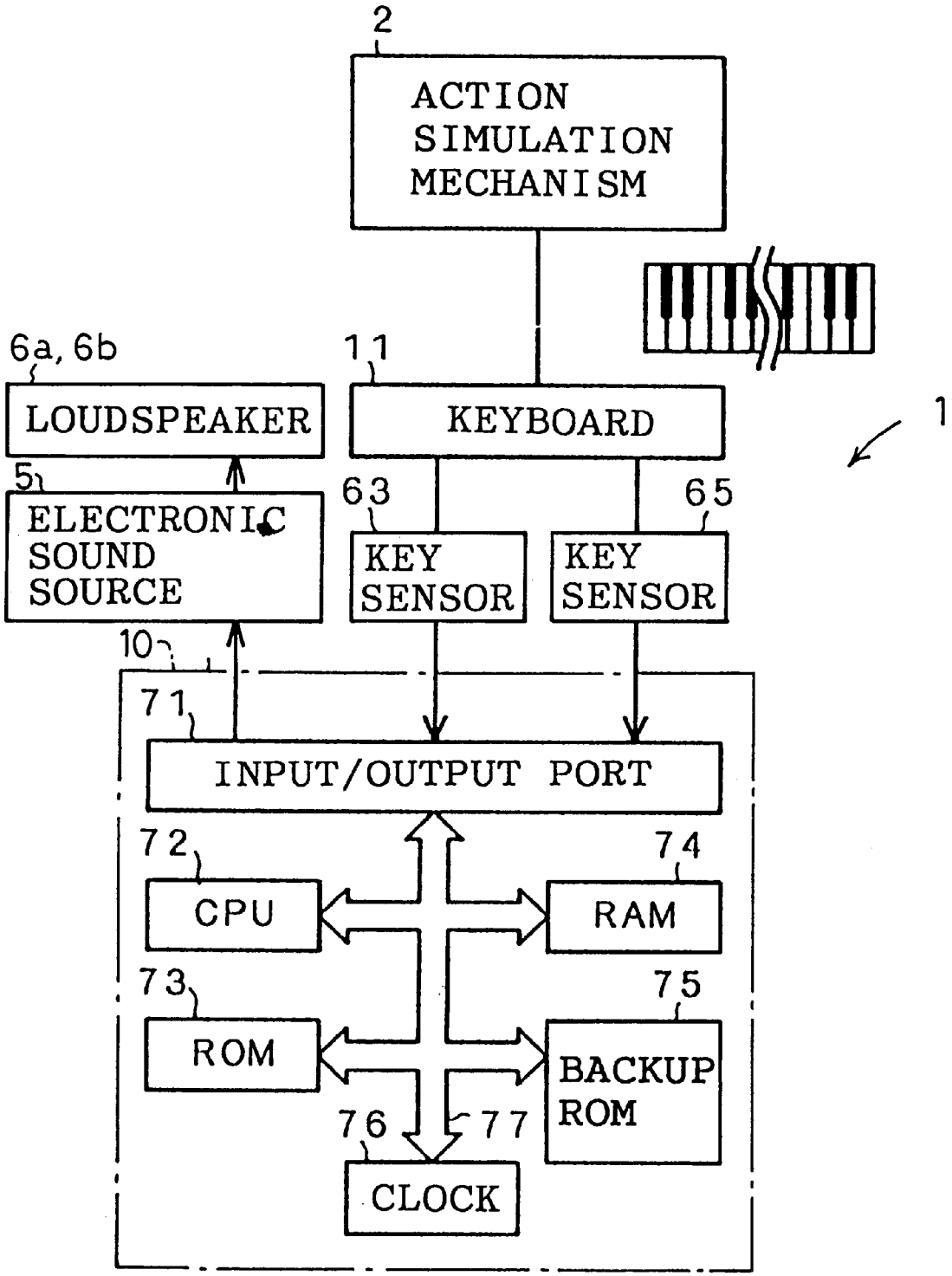
FIG. 1 is a diagrammatic block diagram showing an action simulation mechanism according to a first embodiment of the present invention.

As shown in FIG. 1, an electronic piano 1 of the first embodiment is composed of an action simulation mechanism 2, loudspeakers 6*a*, 6*b*, a keyboard including keys 11, an electronic sound source 5, key sensors 63, 65 and a controller 10.

Figure 4:
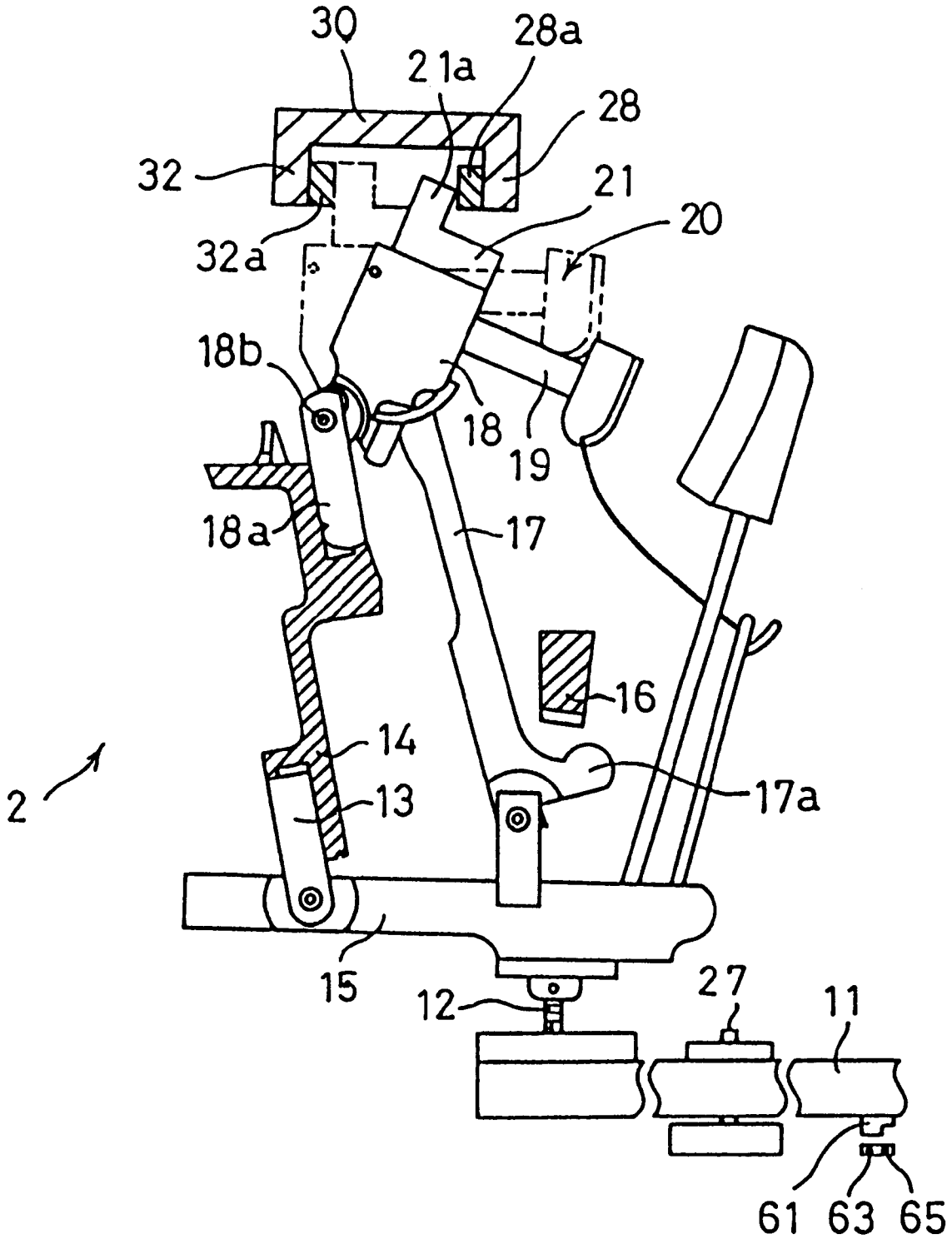
FIG. 4 is a sectional view along the line IV—IV taken on FIG. 3.
Figure 5:
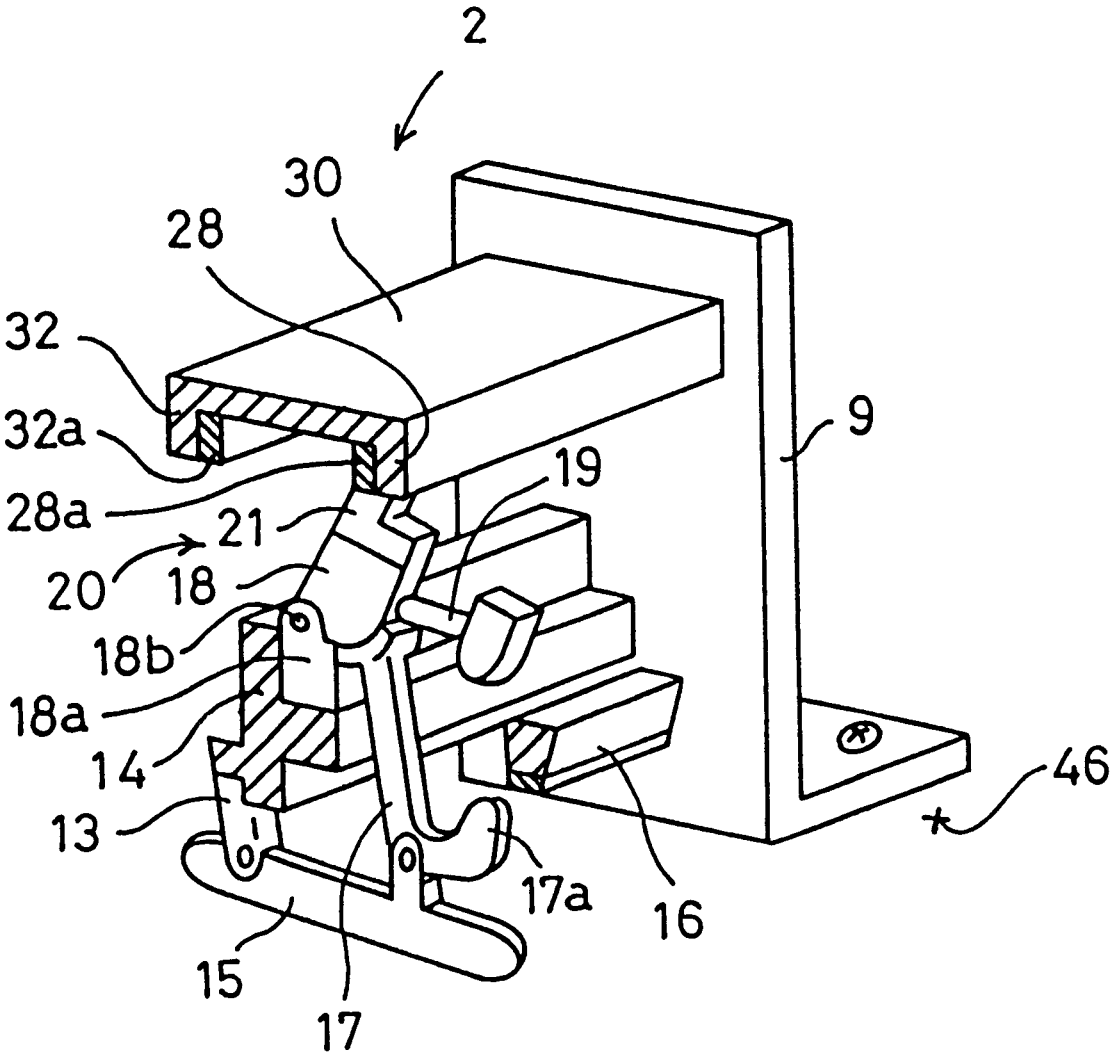
FIG. 5 is a partial perspective view of the action simulation mechanism made in accordance with the present invention.

The action simulation mechanism 2, as shown in FIGS. 4 and 5, is provided with a wippen equivalent member or wippen 15, a jack equivalent member or jack 17, a butt 18, a catcher shank 19 with a catcher, an L-shaped member 21, a stopper part 32 and a hammer rail part 28. The wippen 15 is rotatably attached via a wippen flange 13 to a center rail 14, such that when a key 11 is depressed, a capstan 12 is raised, causing the wippen 15 to rotate in a reverse direction relative to the rotary direction of the depressed key 11. The jack 17 is rotatably connected to the wippen 15, such that the jack 17 rises together with the wippen 15 until a jack tail 17*a* contacts a regulating rail 16. The butt 18, which is in contact with or released from the jack 17, is rotatably supported via a center pin 18*b* of a butt flange 18*a* fixed to the center rail 14. The catcher shank 19 is connected to a side of the butt 18 and the L-shaped member 21 is connected to an upper part of the butt 18. In response to key depression, the L-shaped member rotates such that the stopper part 32 is placed in contact via a felt 32*a* with a projection 21*a* of the L-shaped member 21. After key depression, the L-shaped member 21 rotates such that the hammer rail part 28 is placed in contact via a felt 28*a* with the projection 21*a* of L-shaped member 21. The stopper part 32 and the hammer rail part 28 are provided with cushioning materials, or felts 32*a*, 28*a*, respectively, on opposed faces opposed of an inner wall of a U-shaped stop rail 30.

The butt 18, the L-shaped member 21 and the catcher shank 19 form a hammer equivalent member 20. The butt 18 and the catcher shank 19 have a similar structure to that of the action mechanism of an acoustic piano, and the height of the L-shaped member 21, or distance between an upper face of the butt 18 and an upper face of the projection 21*a*, is about one half or less, for example, ⅓ to 1/20, of that of a hammer found in an acoustic piano. When the butt 18 is raised by the jack 17, the hammer equivalent member 20 rotates counterclockwise as viewed in FIG. 4. The L-shaped member 21 has a L-shaped cross section having an about 0.59 inch high vertical portion and an about 0.79 inch long horizontal portion. Subsequently, the regulating rail 16 causes the jack 17 to rotate and disengage from the butt 18. After the jack 17 and the butt 18 are disengaged, the hammer equivalent member 20 inertially and continuously rotates counterclockwise. The stopper part 32 limits the inertial movement of the hammer equivalent member 20 once the projection 21*a* of L-shaped member 21 contacts the stopper part.

As shown in FIG. 5, the action simulation mechanism 2 is supported by a pair of support members 9 at opposite ends of the electronic piano 1. For simplicity, FIG. 5 shows one of the support members 9. The center rail 14, the regulating rail 16 and the stop rail 30 all extend between the pair of support members 9. The action simulation mechanism 2 with the pair of support members 9 assembled therewith can be attached to or detached from the electronic piano 1. The support members 9 are secured onto a key bed 46 (not shown in FIG. 5).

Figure 6A:
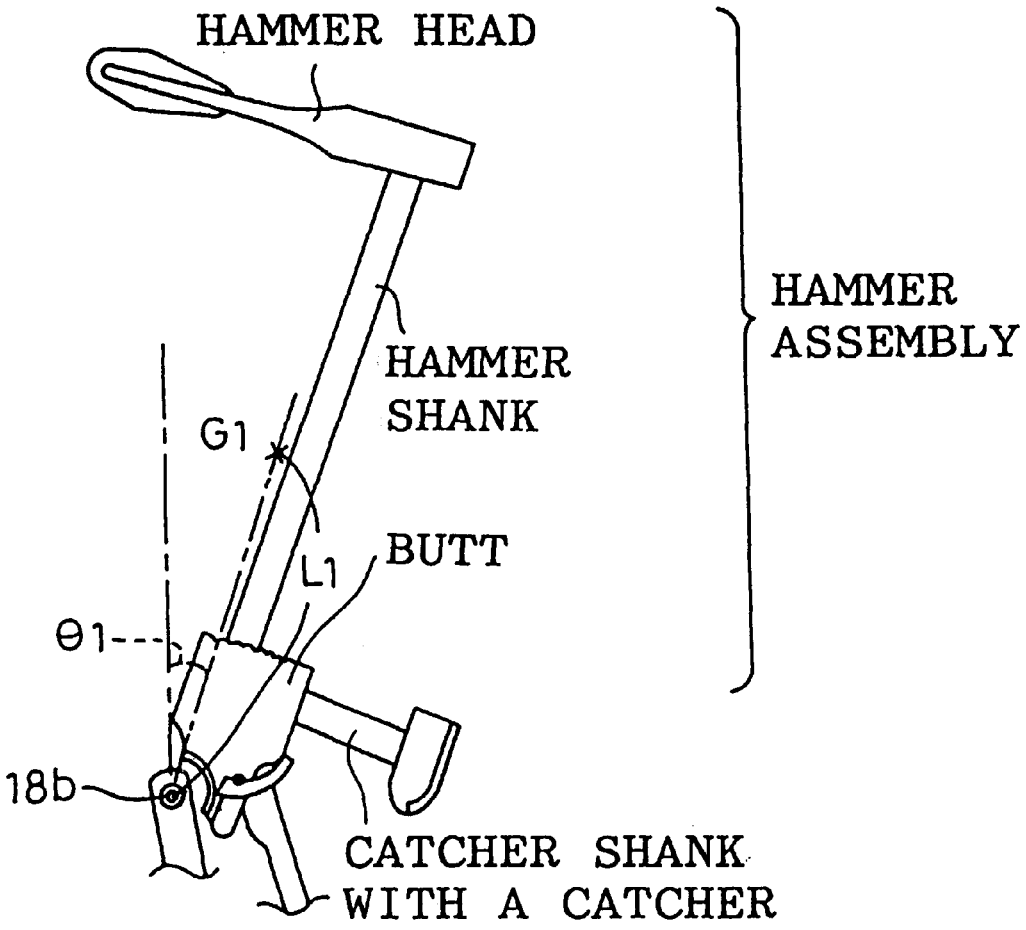
FIG. 6A is a diagrammatic view showing a conventional hammer.
Figure 6B:
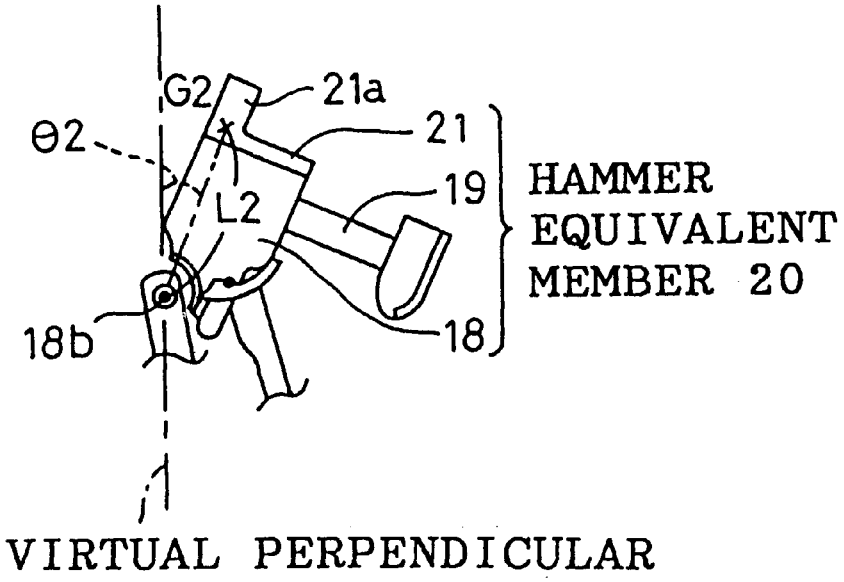
FIG. 6B is a diagrammatic view showing a hammer equivalent member of the first embodiment of the present invention.

As shown in FIG. 6A, the hammer assembly of an acoustic upright piano is composed of a string striking hammer head, a hammer shank, a hammer butt and a catcher shank with a catcher. The inertial moment of the hammer assembly around the center pin 18*b*, designated as I1, is calculated by the relationship I1=(M)(L1), where M is the mass of the hammer and L1 is the distance between the center pin 18*b* and G1 is a center of gravity. Similarly, the hammer equivalent member 20, shown in FIG. 6B, has an inertial moment around the center pin 18*b*, designated as I2, calculated by the relationship I2=(M)(L2), where m is the mass of the hammer equivalent member 20 and L2 is the distance between the center pin 18*b* and G2 is a center of gravity. The mass m and the distance L2 are selected to satisfy the condition represented by mL2=ML1. In this way, the inertial moment I2 is the same as the inertial moment I1. For example, the L-shaped member 21 can be formed of iron or other metal having a large specific gravity. The angle θ2 formed by the gravity center G2 relative to a virtual perpendicular passing the center pin *18*b is designed to be the same as the angle θ1 formed by the gravity center G1 and the virtual perpendicular.

Figure 2:
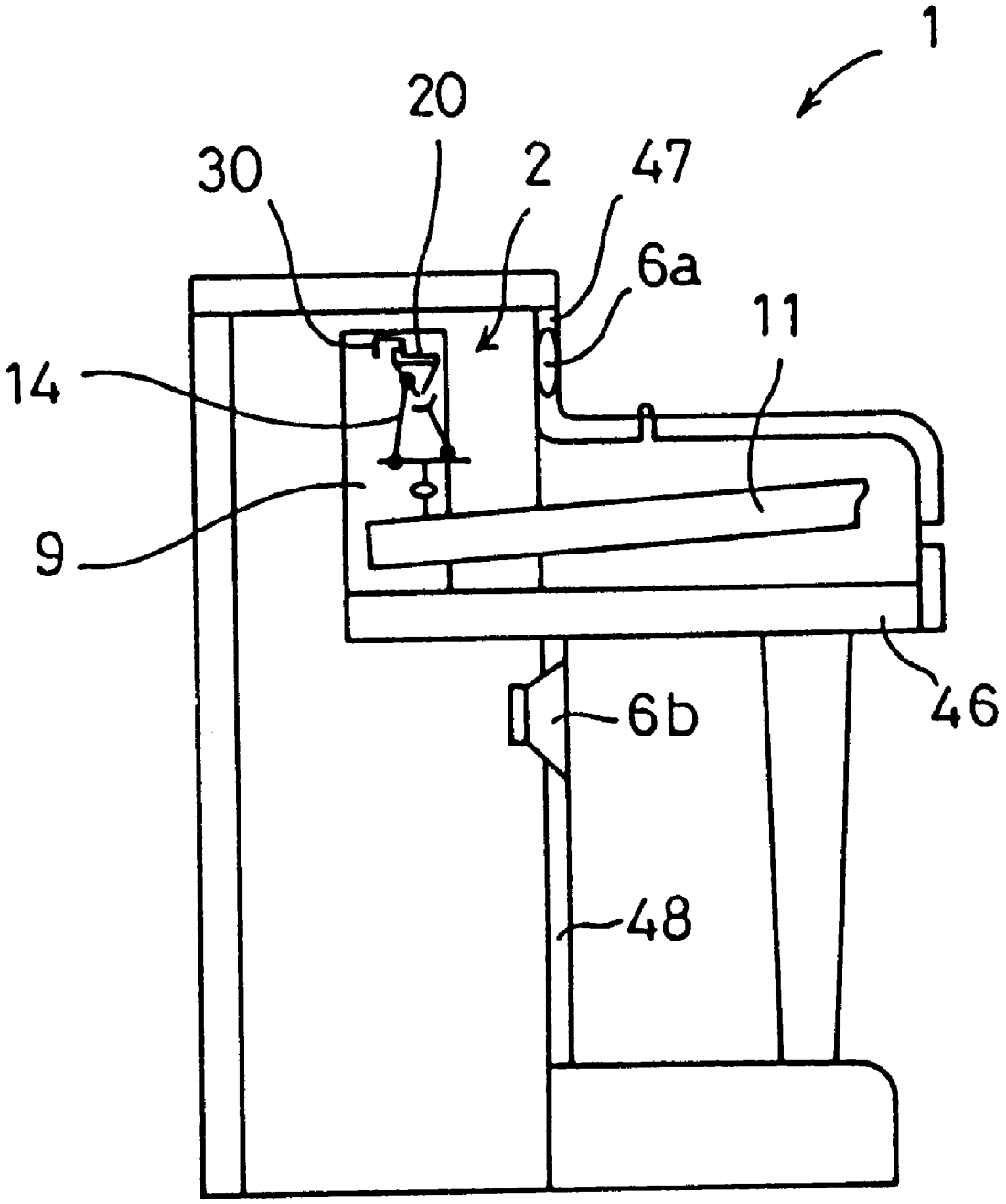
FIG. 2 is a cross-sectional view of an electronic piano provided with the action simulation mechanism of the first embodiment of the present invention.

As shown in FIG. 2, a plurality of keys 11 are arranged along the key bed 46. As shown in FIG. 4, the key 11 is oscillatably supported by a balance pin 27 and key sensors 63, 65 are provided under the key 11.

As shown in FIG. 4, each of the key sensors 63 and 65 are a photo-interrupter, or detector, composed of an emitter element and a receiver element, for detecting key depression and release. In the key sensors 63 and 65, a light path is formed between the emitter element and the receiver element. When the light path of key sensors 63, 65 is interrupted by a stepped shutter 61 attached to the underside of key 11, an ON signal is transmitted. Specifically, after the key 11 is depressed, the light path of key sensor 63 is first blocked by the stepped shutter 61, transmitting an ON signal, and subsequently with a time lag, the light path of key sensor 65 is blocked by the stepped shutter 61, transmitting an ON signal. As shown in FIG. 1, these key sensors 63 and 65 are connected to the controller 10.

Figure 3:
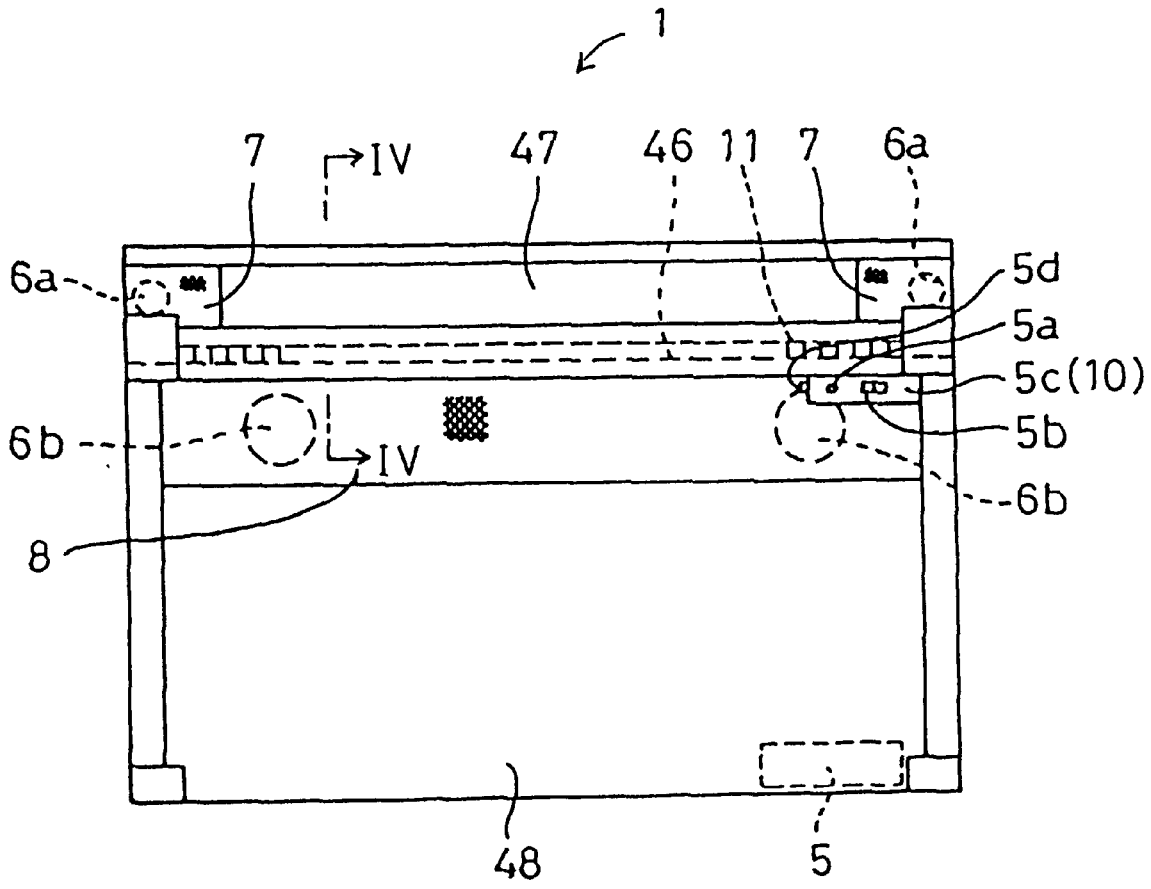
FIG. 3 is a front view of the electronic piano of the first embodiment of the present invention.

The controller 10, as shown in FIG. 3, is located inside a control box 5*c*, and, as shown in FIG. 1, is an arithmetic logic circuit including an input/output port 71, a CPU 72, a ROM 73, a RAM 74, a backup ROM 75 and a clock 76 interconnected with a bus 77. The controller 10 is connected via the input/output port 71 to the key sensors 63 and 65 and to the electronic sound source 5. The timing and the time lag between the blocking of the light paths in the key sensors 63 and 65 are detected by the CPU 72 and are temporarily stored in the RAM 74. The ON signal is transmitted to the electronic sound source 5 based on the control program stored in the ROM 73. The controller 10 is also connected to a pedal sensor (not shown) for detecting the operation of a damper pedal, a soft pedal or other pedal mechanism. Such pedal detection information is included in the signal transmitted to the electronic sound source 5.

As shown in FIG. 3, the electronic sound source 5 is fixed to the inner bottom face of electronic piano 1. The control box 5C with a power switch 5a and a volume adjuster 5*b* for the electronic sound source 5 is fixed to the underside of key bed 46. By inserting a headphone plug into a headphone jack 5*d* also provided in the control box 5*c*, an output signal is transmitted to the headphone and no output signal is transmitted to the loudspeakers 6*a* or 6*b*. The loudspeakers 6*a*, for emitting medium or high tones, are disposed at opposite sides of an upper frame 47 and are each protected with an upper net 7, while the loudspeakers 6*b*, for emitting low tones, are disposed at the opposite sides of the upper part of a lower frame 48 and are each protected with a lower net 8.

The operation of the electronic piano 1 having the aforementioned structure is now explained referring to FIG. 4. When a player depresses the key 11, the key 11 rotates clockwise, as viewed in the figure, about the balance pin 27, and the wippen 15 rotates in the reverse direction relative to the rotary direction of the key 11, or counterclockwise as viewed in the figure. Accordingly, the jack 17 moves up and influences the butt 18. The butt 18 rotates together with the L-shaped member 21 in the reverse direction relative to the rotary direction of key 11, or counterclockwise as viewed in the figure. After the jack 17 rises to a predetermined position, the jack tail 17*a* contacts the regulating rail 16, thereby causing the jack 17 to rotate clockwise as viewed in the figure and disengage from the butt 18. The butt 18 and L-shaped member 21, disengaged from the jack 17, inertially rotate. The projection 21*a* of the L-shaped member 21 contacts the stopper part 32 of the stop rail 30, as shown by double dotted line in FIG. 4, thereby limiting the inertial rotation of the hammer equivalent member 20. When the player releases the key, the butt 18 and the L-shaped member 21 return, until the projection 21*a* contacts the hammer rail part 28 of the stop rail 30, as shown by a solid line in FIG. 4.

Figure 7:
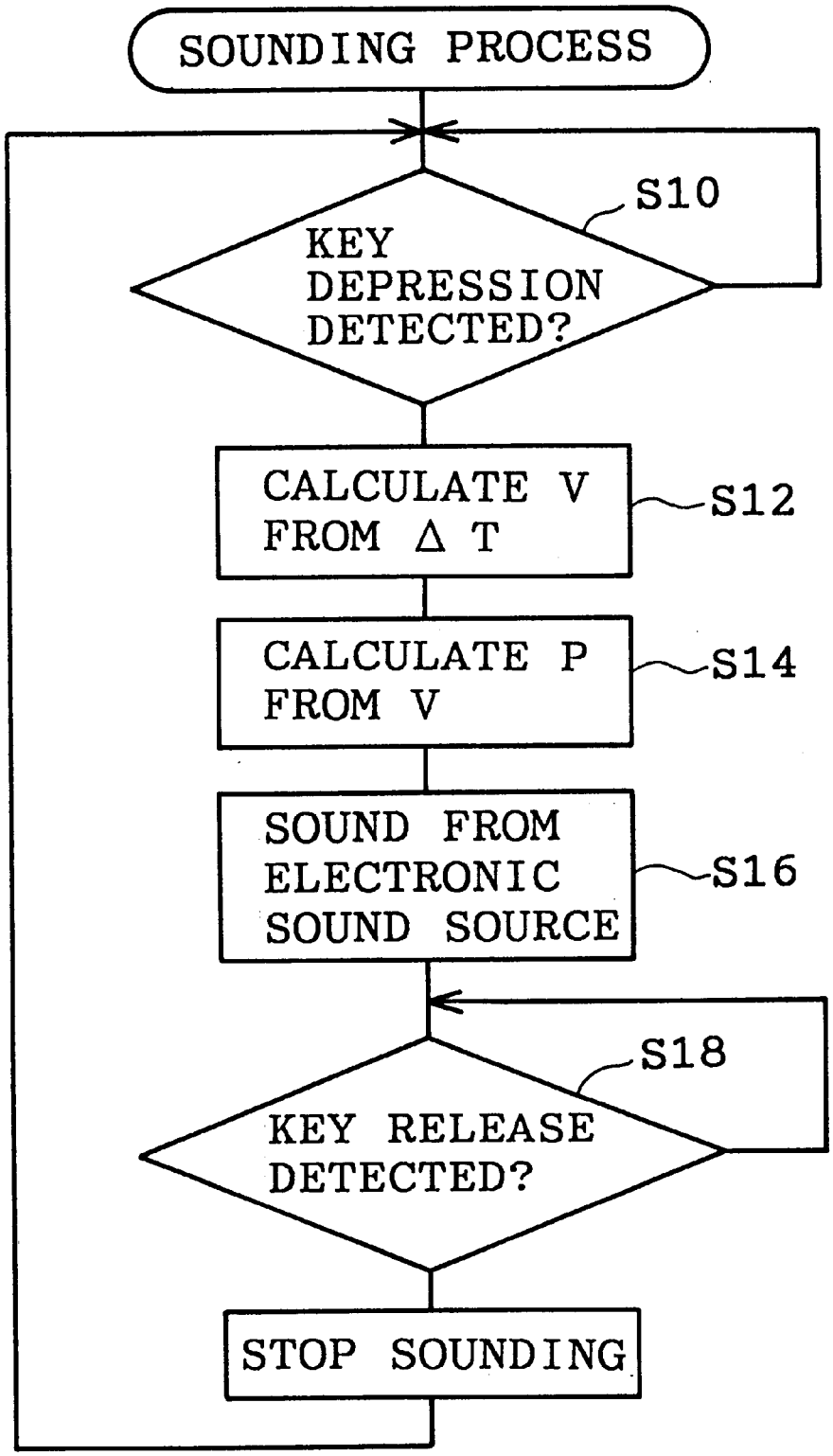
FIG. 7 is a flowchart of a sounding process.

When the action simulation mechanism 2 is operated as aforementioned, the light paths in the key sensors 63 and 65 are interrupted by the stepped shutter 61, and the CPU 72 in the controller 10 executes a sounding process, i.e. one of the control programs stored in the ROM 73. The sounding process is now explained referring to the flowchart of FIG. 7.

When the sounding process starts, it is first determined at step S10 whether or not the key depression is detected by the key sensors 63 and 65. Specifically, a key depression is detected when an ON signal is transmitted from the key sensor 63 to the controller 10, and an ON signal is transmitted from the key sensor 65 to the controller 10. If the answer to step S10 is negative, or no key depression is detected, the process repeats step S10. On the other hand, if the answer to step S10 is affirmative and a key depression is detected, the process advances to step S12 in which a key depression velocity V is calculated from a time interval ΔT between the ON signal from the key sensor 63 and the ON signal from the key sensor 65, for example, by means of the following formula:

$$V=K/\Delta T,$$

in which K is a constant.

Subsequently, at step S14, a key depression strength P is calculated from the key depression velocity V, for example, by means of the following formula:

$$P=(K')\cdot(V),$$

in which K is a constant.

At step S16, a predetermined waveform signal is obtained based on a key number and the key depression strength P, and by controlling the electronic sound source 5, sound is emitted from the loudspeakers 6*a*, 6*b* based on the waveform signal.

Subsequently, it is determined at step S18 whether or not a key release is detected by the key sensors 63 and 65. Specifically, a key release is detected when an OFF signal is transmitted from the key sensor 65 to the controller 10, and an OFF signal is transmitted from the key sensor 63 to the controller 10. If the answer to step S18 is negative or no key release is detected, the process repeats step S18. On the other hand, if the answer to step S18 is affirmative and the key release is detected, the process advances to step S20 in which the sounding of electronic sound source 5 is discontinued and the process returns to step S10.

Figure 8:
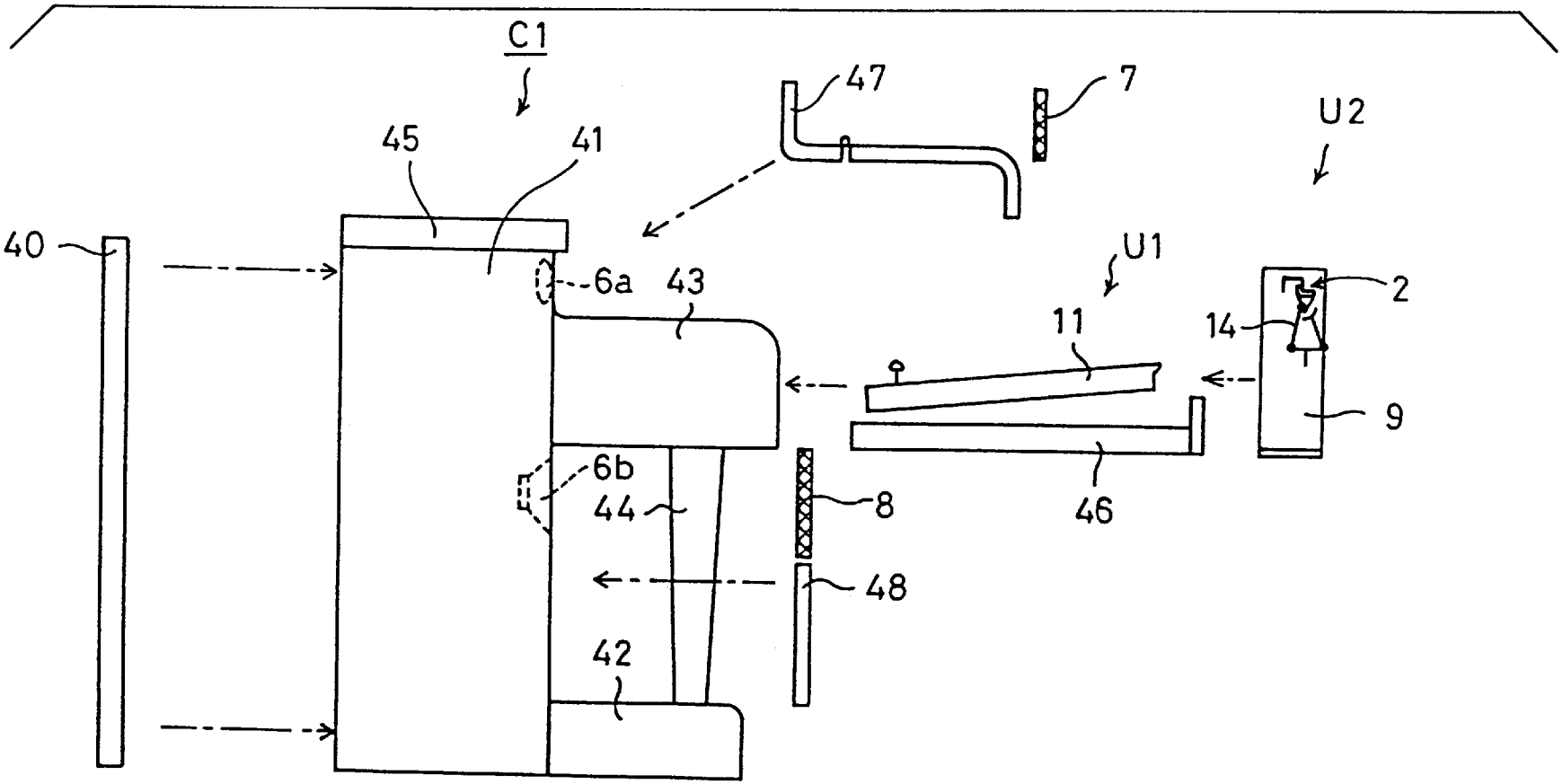
FIG. 8 is an exploded view of the electronic piano made in accordance with the present invention.

The manufacture or assembly of the electronic piano 1 provided with the aforementioned action simulation mechanism 2 is now explained referring to FIG. 8. First, toe blocks 42, arms 43, legs 44, a back plate 40, a roof 45 and the loudspeakers 6*a*, 6*b* are attached to a pair of opposite end panels 41, only one of which is shown for simplicity, thereby forming a cabinet C1. A key frame with the key sensors 63, 65 attached thereto (not shown in FIG. 8), the keys 11 and the key bed 46 are integrally formed in a key bed unit U1. The key bed unit U1 is fixed to a L-shaped fastener (not shown in FIG. 8) and secured to each opposite arm 43, only one of which is shown in FIG. 8 for simplicity. Further, cheek-blocks (not shown) are mounted. Subsequently, an action unit U2, composed of the action simulation mechanism 2 assembled with the support members 9, is disposed at the rear of the key bed unit U1 (toward the left end of the key bed 46, as shown in FIG. 8), and the support members 9 are fixed to the key bed 46. Afterwards, the upper frame 47, the upper nets 7, the lower nets 8 and the associated components are mounted. The electronic piano 1 of the first embodiment of the present invention, shown in FIGS. 1–3, is thus manufactured.

The first embodiment of the electronic piano 1 provides the following effectiveness.

(1) Like an acoustic upright piano, the wippen 15, the jack 17 and the butt 18 are rotated about the independent axes. When the butt 18 is pushed up by the jack 17, the hammer equivalent member 20 rotates. Subsequently, when the jack 17 disengages from the butt 18, the hammer equivalent member 20 inertially moves. The inertial movement of the hammer equivalent member 20 is discontinued by the stopper part 32. Both the inertial moment I2 and the angle θ2 of the gravity center relative to the virtual perpendicular passing through the center pin 18*b* are designed to be the same as those of an acoustic piano. Therefore, the let-off timing of the jack 17 and butt 18 and the feel of depressing a key are the same as those of an acoustic upright piano.

(2) The hammer equivalent member 20 is sufficiently shorter than the hammer shank of an acoustic piano, thereby decreasing the height of the piano roof. Therefore, the electronic piano 1 provides the acoustic piano key touch, while its appearance is compact, like a conventional electronic piano.

(3) The stop rail 30 is provided with the stopper part 32 and the hammer rail part 28. The number of components is reduced, thereby facilitating assembly and decreasing manufacturing costs.

Modifications of the First Embodiment

The stop rail 30 can be divided into the stopper part 32 and the hammer rail part 28. Alternatively, the catcher shank 19 with the catcher can be eliminated from the hammer equivalent member 20.

Figure 9A:
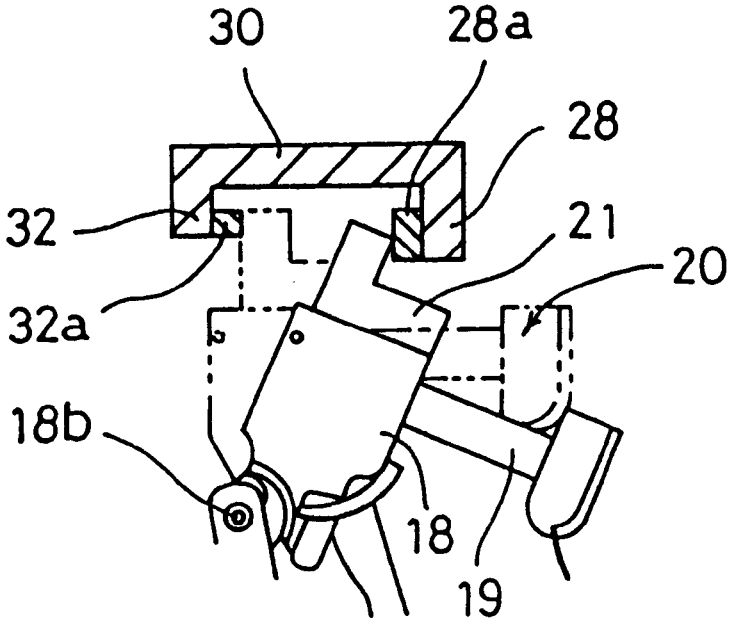
FIGS. 9A and 9B are diagrammatical views of modified stop rails for use in the first embodiment of the present invention.
Figure 9B:
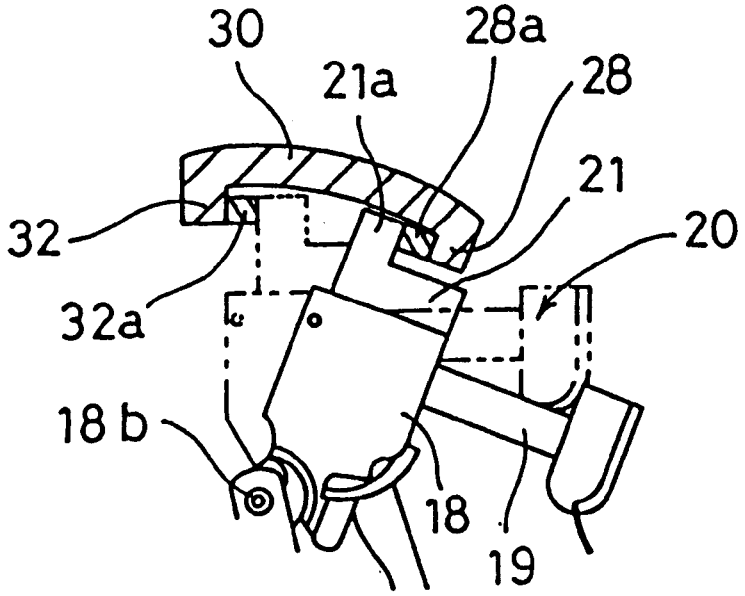

As shown in FIG. 9A, the stopper part 32 of stop rail 30 can be shortened. The stop rail 30 thus has a reduced cross-sectional area and a reduced weight. Alternatively, as shown in FIG. 9B, the cross-sectional configuration of stop rail 30 can be a circular arc along a circumference centering on the center pin 18*b*. The stop rail 30 also has a reduced cross-sectional area and a reduced weight.

Figure 10A:
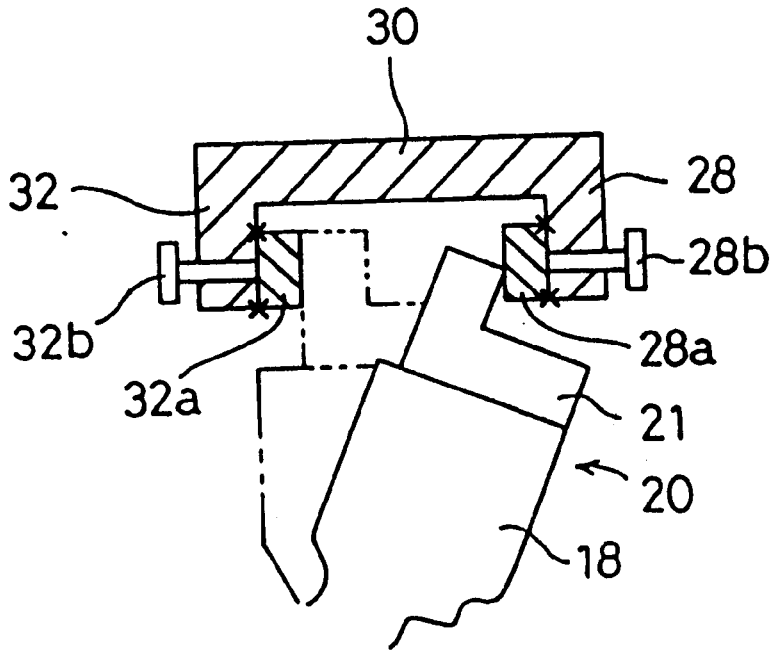
FIGS. 10A and 10B are diagrammatical views of modified stop rails for use in the first embodiment of the present invention.
Figure 10B:
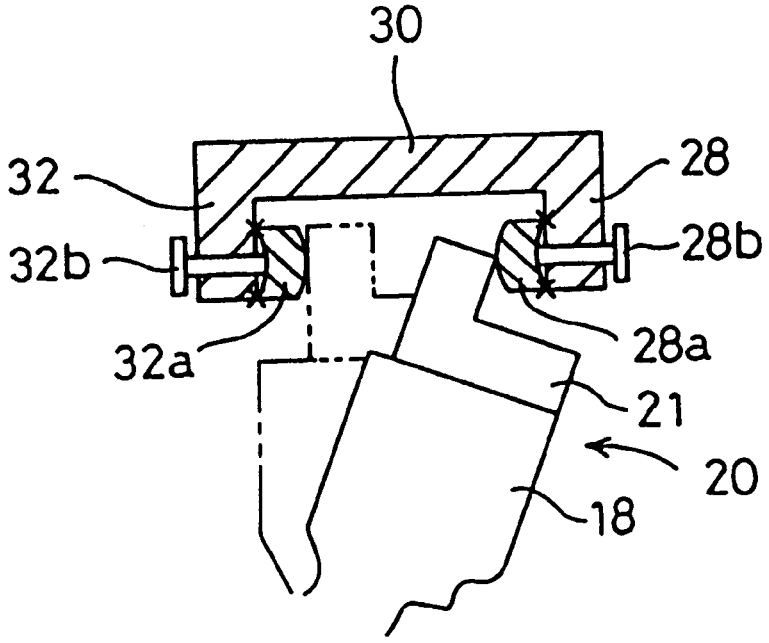

Furthermore, as shown in FIGS. 10A and 10B, the stopper part 32 of stop rail 30 can be provided with an adjustment screw 32*b* for varying the stop position of the hammer equivalent member 20 by adjusting the position of felt 32*a*. The upper and lower points of felt 32*a*, shown by crosses in FIGS. 10A and 10B, are preferably adhered to the stopper part 32. If the felt 32*a* is worn by the repeated contacts with the L-shaped member 21, the stop position of the L-shaped member 21 is deviated backward, or to the left as viewed in the figures, from its original position. By using the adjustment screw 32*b*, the felt 32*a* can be influenced to the right as viewed in the figures, or toward the original position (FIG. 10B). Preferably, an adjustment screw 32*b* is provided for each L-shaped member 21 to accommodate individual adjustment. As shown in FIGS. 10A and 10B, an adjustment screw 28*b* can be also provided on the hammer rail part 28, such that the return position of the hammer equivalent member 20 can be similarly varied.

Second Embodiment

Figure 15:
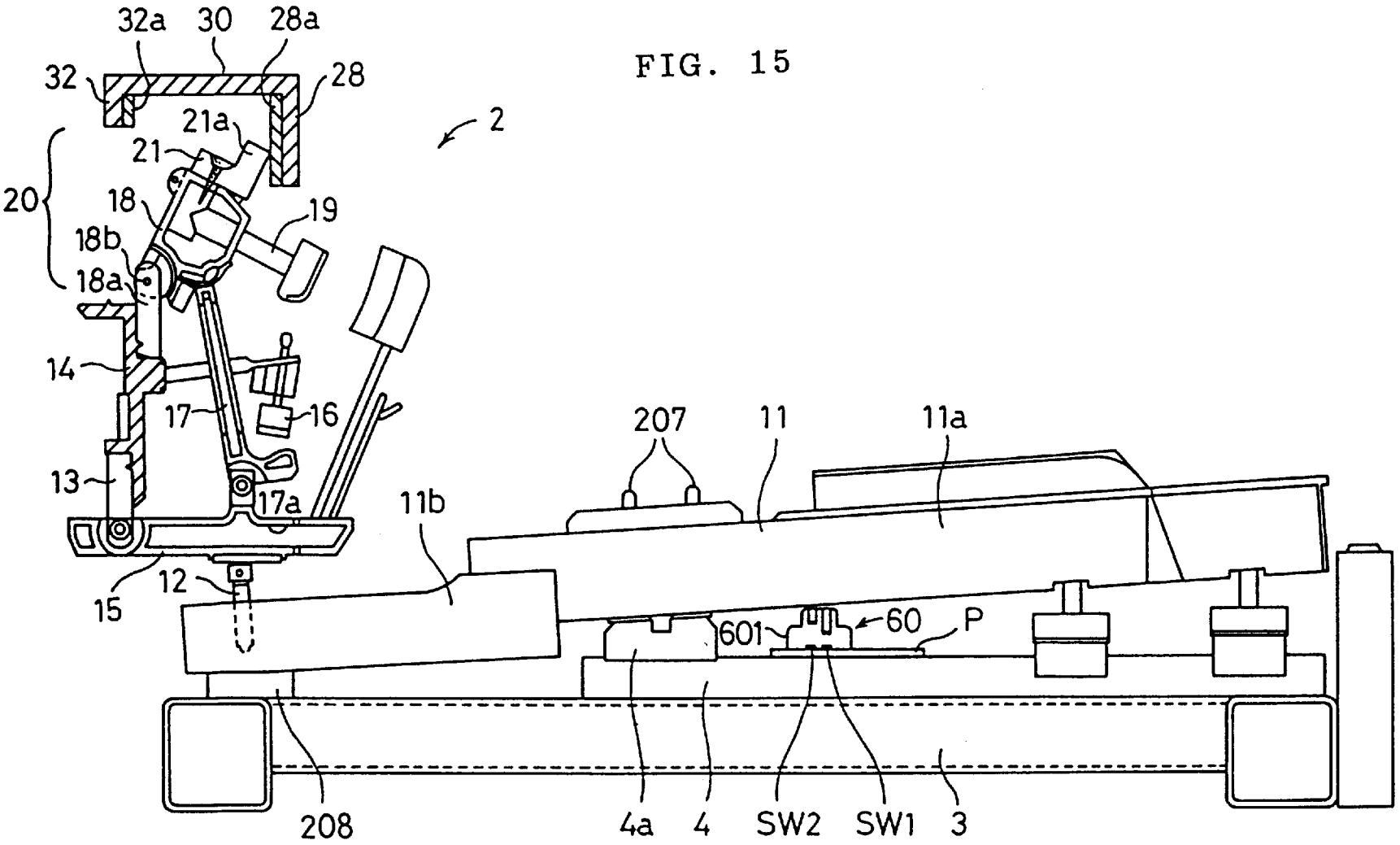
FIG. 15 is a diagrammatical view of a second embodiment of an action simulation mechanism made in accordance with the present invention.

In the second embodiment, as shown in FIG. 15, a button switch 60 replaces the key sensors 63 and 65 shown in FIG. 4. The key 11 is composed of a key body 11*a* extending from the front (right) of the figure toward the back (left) of the figure to about the middle of a key bed 3, and a lowered or stepped member 11*b* extending from the back end (left end) of the key body 11*a* toward the left as viewed in the figure. A key frame 4 extends from the front of the key bed 3 to about the middle of the key bed 3. The key 11 is rotatably supported at about the middle of the key 11 via a balance pin 207 on an intermediate plate 4a piled on the key frame 4. A key pad 208, provided on the back end (left end) of the key bed 3, is in contact with the underside of stepped member 11*b* while the key 11 remains in its initial position, i.e. before key depression and after key release. The capstan 12 is screwed or fixed to the stepped member 11*b* and the head of capstan 12 is in contact with the underside of the wippen 15 of the action simulation mechanism 2.

As shown in FIG. 15, the button switch 60 is provided with first and second switches, SW1 and SW2, respectively, in a cover 601 formed of rubber, synthetic resin or other resilient material. Each switch SW1, SW2 is composed of a pair of fixed and movable contacts. The button switch 60 is opposed to the underside of the key 11 and is positioned on a printed board P. Upon key depression, when the key 11 reaches a predetermined position set between the initial position and a stroke depth, the first switch SW1 is closed by the underside of the key 11, and when the key 11 reaches the stroke depth, the second switch SW2 is closed by the underside of the key 11.

The second embodiment of the electronic piano 1 provides the following effectiveness.

Figure 16:
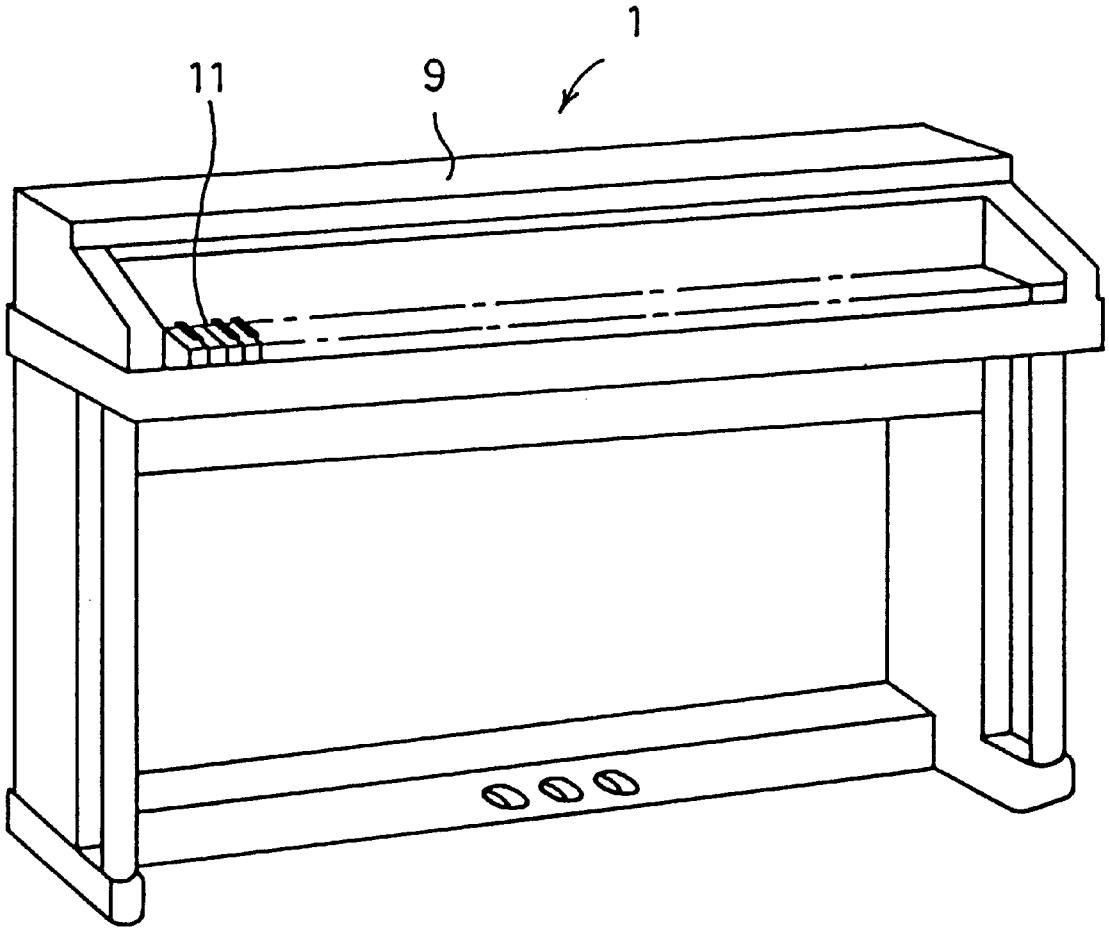
FIG. 16 is a perspective view of the second embodiment of an electronic piano made in accordance with the present invention.

(1) The upper surface of the stepped member 11*b* is lower than the upper surface of the key body 11*a*. The key 11 is operatively connected via the stepped member 11*b* to the action simulation mechanism 2. Therefore, the height of action simulation mechanism 2 is lowered than that of an action simulation mechanism 2 connected to a key without the step member 11*b*. Additionally, the hammer equivalent member 20 is sufficiently lower than the hammer assembly of an acoustic upright piano. Therefore, as shown in FIG. 16, the electronic piano 1 can have a roof 9 having a reduced height or compact appearance peculiar to the electronic piano.

Modifications of the Second Embodiment

Figure 11:
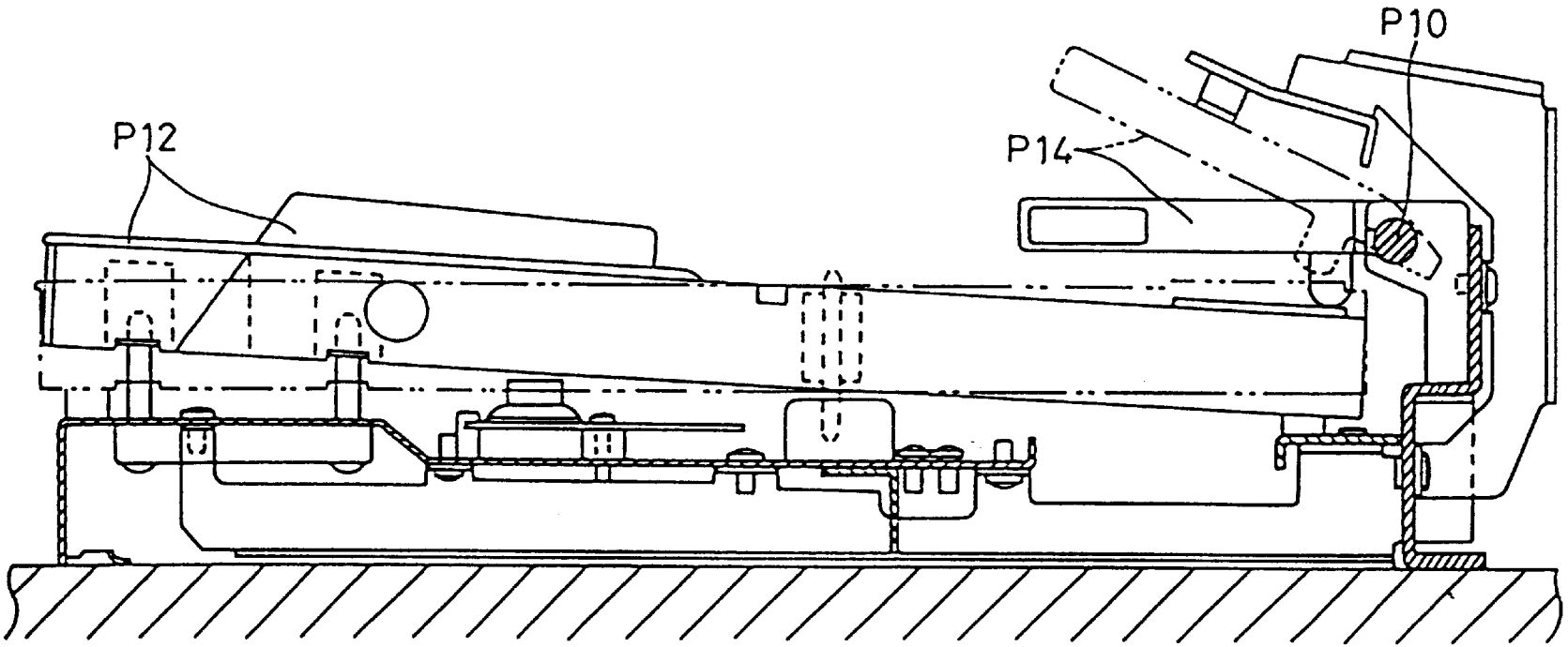
FIG. 11 PRIOR ART
FIG. 11 is a diagrammatical view of a conventional action simulation mechanism.
Figure 12:
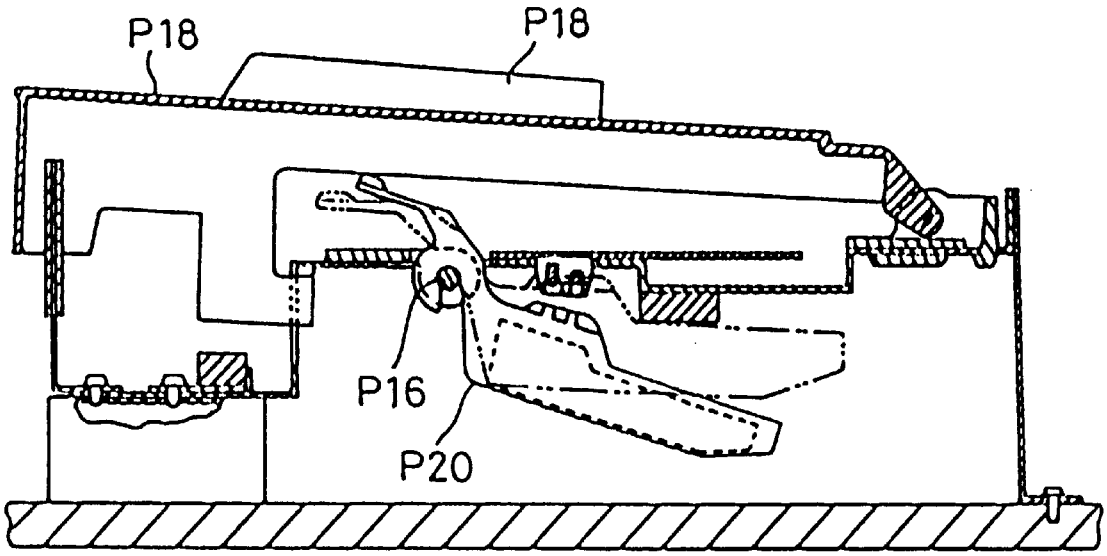
FIG. 12 PRIOR ART
FIG. 12 is a diagrammatical view of a conventional action simulation mechanism.
Figure 13:
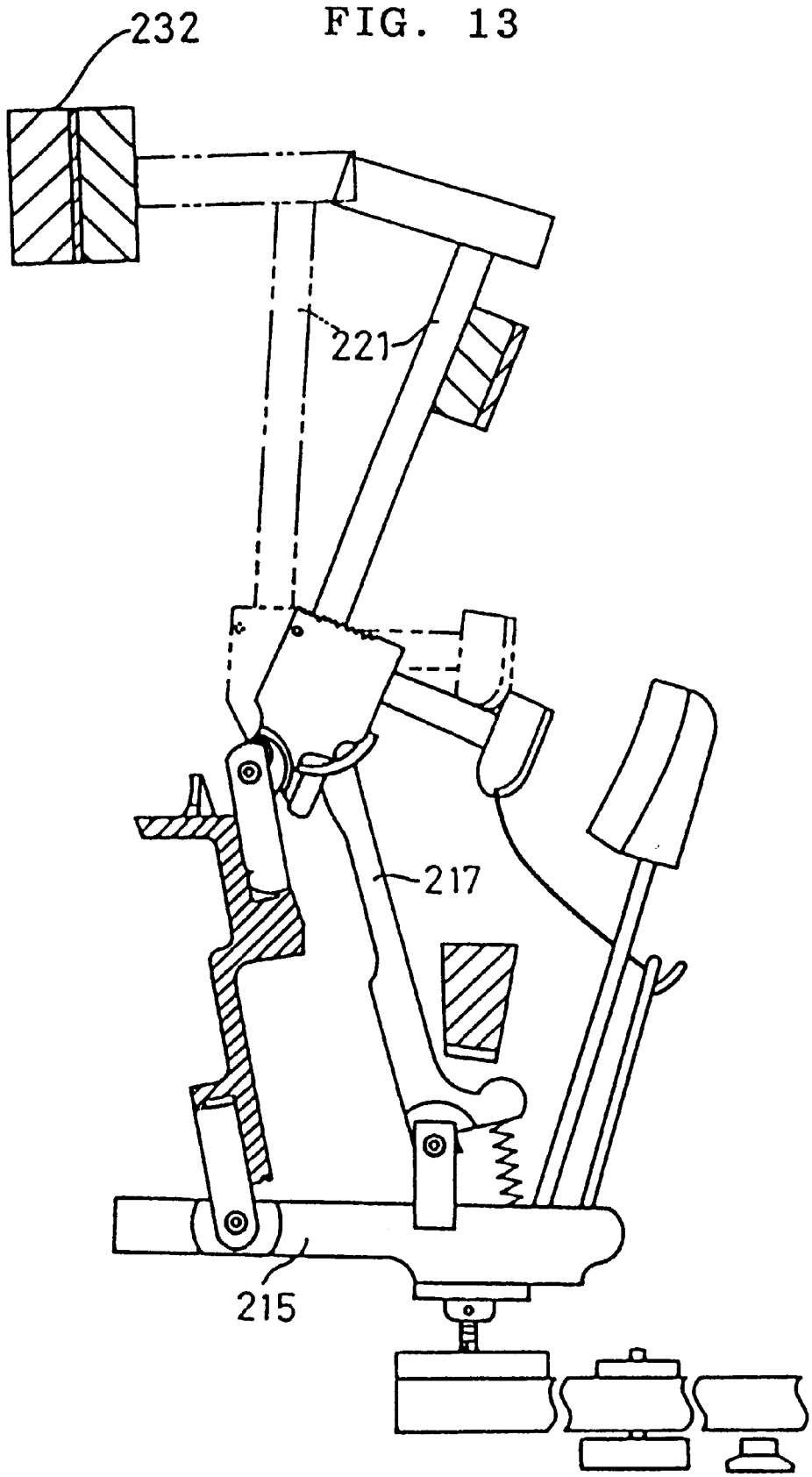
FIG. 13 is a diagrammatical view of an action simulation mechanism equivalent to an acoustic piano action mechanism.

In the second embodiment, the action simulation mechanism 2 can be replaced with the conventional action simulation mechanism shown in FIG. 11, 12 or 13. The appearance configuration of the electronic piano can be made compact because the stepped member 11*b* of key 11 can be a reduction in the height of the action simulation mechanism.

Third Embodiment

Figure 17:
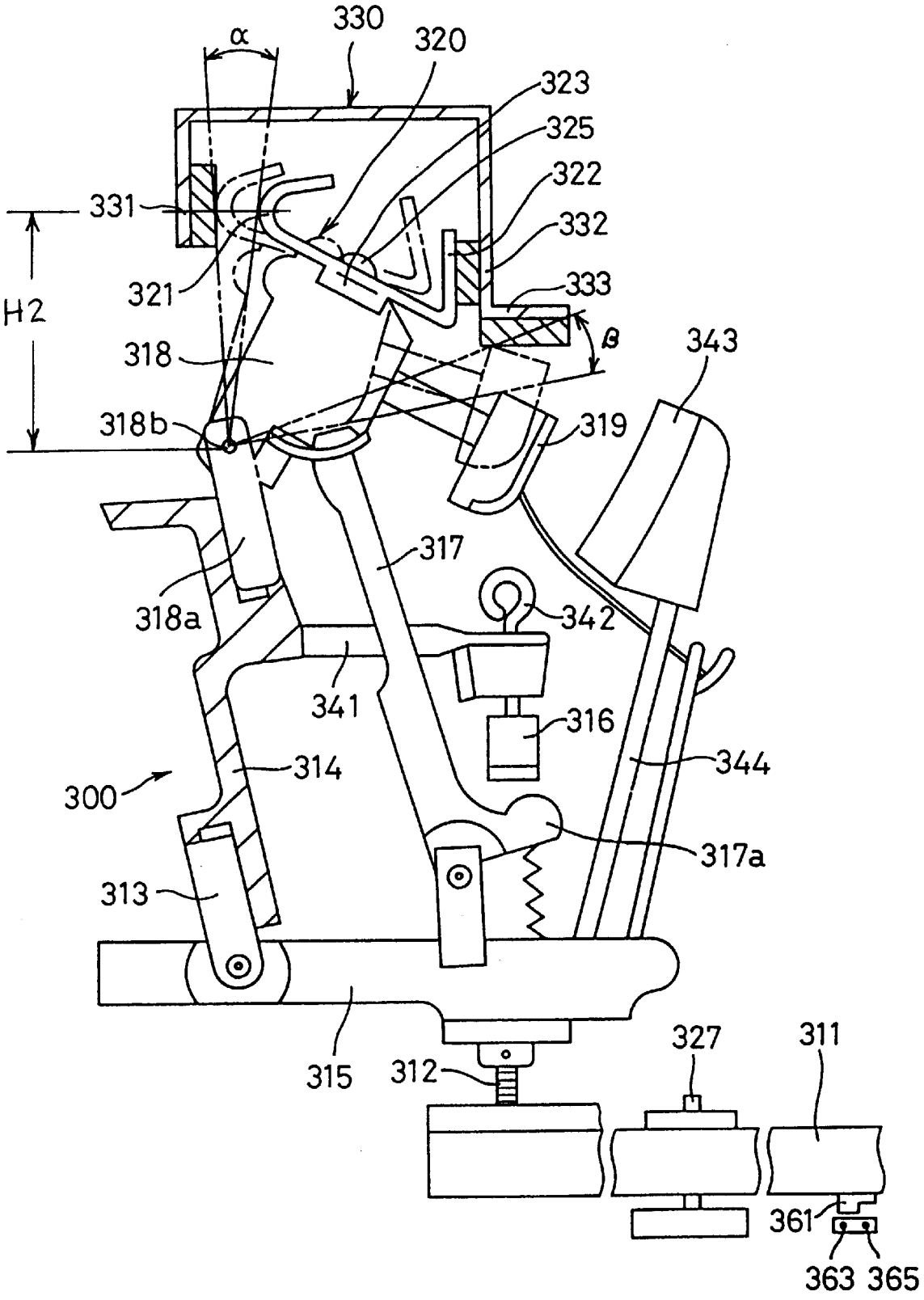
FIG. 17 is a sectional view of a third embodiment of an action simulation mechanism made in accordance with the present invention.

In the third embodiment, as shown in FIG. 17, an action simulation mechanism 300, disposed behind a key 311, is provided with a wippen 315, a jack 317, a butt 318, and a stop rail 330.

The wippen 315 is rotatably attached via a wippen flange 313 to a center rail 314 mounted to an electronic piano body, such that the wippen 315 is rotated in the direction reverse to the rotary direction of the depressed key 311 or counterclockwise in the figure, when a capstan 312 is raised. A back check 343 is supported by a wire 344 on the wippen 315.

The jack 317 is rotatably connected to the wippen 315, such that the jack 317 rises together with the wippen 315 until a jack tail 317*a* contacts a regulating button 316. The regulating button 316 is fixed with a screw 342 to a regulating rail 341. The height of the regulating button 316 can be adjusted by turning the screw 342.

Figure 14:
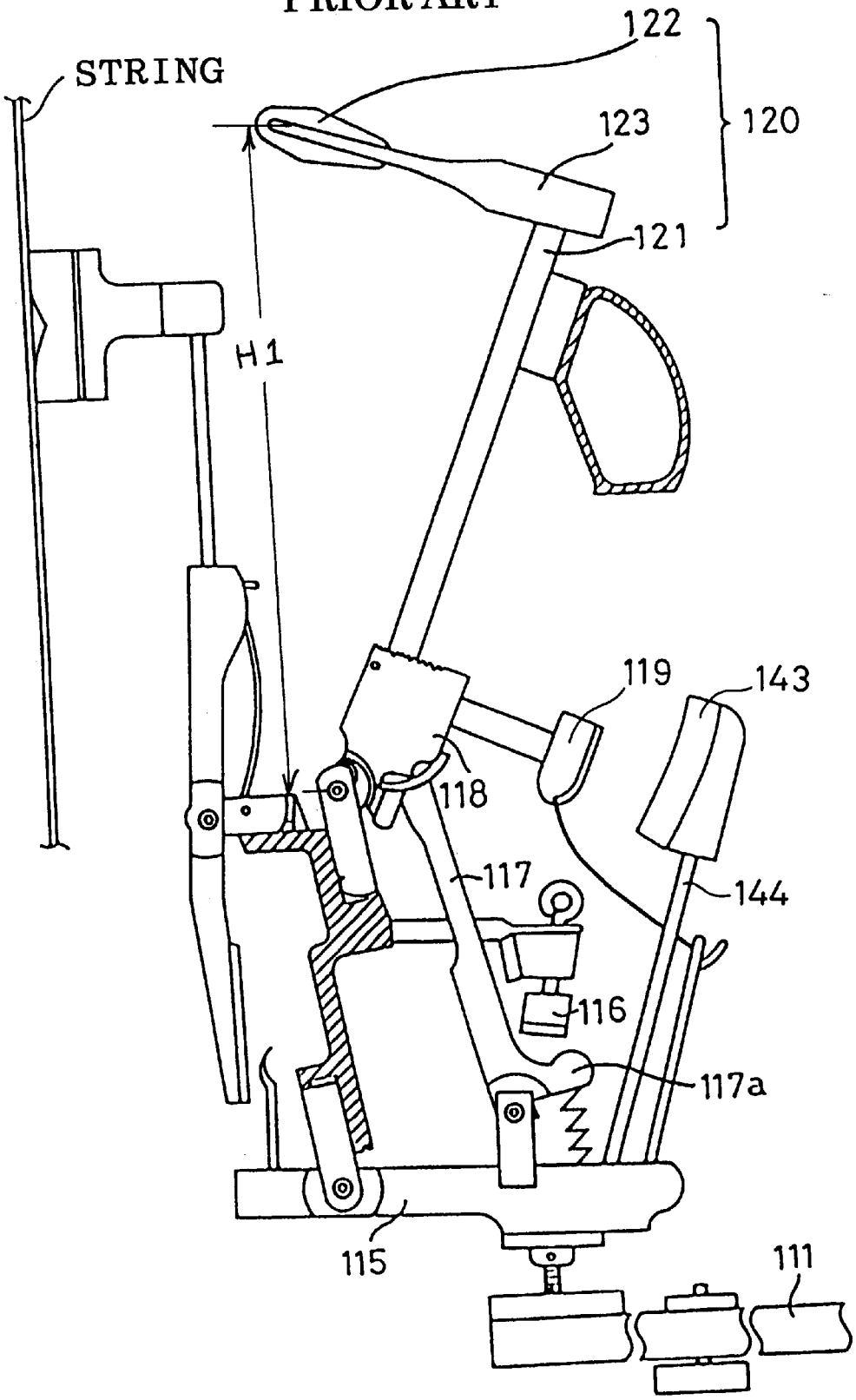
FIG. 14 PRIOR ART
FIG. 14 is a diagrammatical view of the acoustic piano action mechanism.

The butt 318, which is in contact with or released from the jack 317, is rotatably supported via a center pin 318*b* provided in a butt flange 318*a* fixed to the center rail 314. A hammer simulation member 320 is fixed with a fastener screw 325 to the upper face of butt 318. By press working a metal sheet, the hammer simulation member 320, shown in FIGS. 19, 20A and 20B, has a curved hammer part 321 at one end and a rest part 322 forming an acute angle at the other end. An insertion bore 324 is formed in about the center of the metal sheet and a pair of butt holding parts 323 are opposed to each other at an interval almost equal to the width of the butt 318. The hammer simulation member 320 is fastened to the butt 318 with a fastener screw 325 through the insertion bore 324, with the butt 318 being received by the pair of butt holding parts 323 to prevent the hammer simulation member 320 from rotating around the fastener screw 325. The butt 318 and the hammer simulation member 320 are in a fixed positional relationship. The height (axial length) of the hammer simulation member 320 is significantly less than that of the hammer assembly 120 of an acoustic piano shown in FIG. 14. For example, the height (axial length) of the hammer simulation member 320 is from about ½ to about 1/20 of the height (axial length) of the hammer assembly 120. A catcher member 319 is fixed to the side of butt 318, projecting toward the front of the electronic piano 1, or to the right as viewed in FIG. 17.

The stop rail 330 is extended along the arrangement direction of the keys 311, covering the hammer simulation member 320 fixed to the butt 318. The stop rail 330 is provided with a hammer stopper part 331, a hammer rail part 332 and a catcher stopper part 333.

As shown by a dotted line in FIG. 17, the hammer stopper part 331, a string simulating member, contacts the hammer part 321 when the hammer simulation member 320 swings in response to key depression. As shown by a solid line in FIG. 17, the hammer rail part 332, a hammer rail simulating member, contacts the rest part 322 when the hammer simulation member 320 returns to its initial position upon key release. The hammer stopper part 331 and the hammer rail part 332 comprise opposed inwardly facing surfaces of the stop rail 330 and on these surfaces a felt urethane rubber or other cushioning material is placed. The catcher stopper part 333 is formed of a felt, urethane rubber or other cushioning material, positioned on the stop rail 30 to be in contact with the catcher member 319, when the catcher member 319 is rotated in response to key depression.

During key depression, the catcher member 319 rotates through a rotary angle β, relative to the center pin 318*b*, from its initial position until it contacts the catcher stopper part 333. Also during key depression, the hammer part 321 of hammer simulation member 320 rotates through a rotary angle α, relative to the center pin 318*b*, from its initial position until it contacts the hammer stopper part 331. The rotary angle β is about equal to the rotary angle α.

The operation of the electronic piano of the third embodiment is now explained referring to FIG. 17. When a player depresses the key 311, the key 311 is rotated clockwise as viewed in the figure, and the wippen 315 is rotated in the direction reverse to the rotary direction of key 311, or counterclockwise as viewed in the figure. Accordingly, the jack 317 rises, thereby thrusting the butt 318 upwards and causing the butt to rotate counterclockwise. Subsequently, the jack tail 317*a* contacts the regulating button 316 and is thereby rotated clockwise to release the butt 318 at a let-off timing. The let-off timing can be adjusted by adjusting the height of the regulating button 316 by turning the screw 342. After the let-off timing, the butt 318 inertially rotates counterclockwise as viewed in the figure, together with the hammer simulation member 320 and the catcher member 319. During the inertial movement of the hammer simulation member 320, the hammer part 321 contacts the hammer stopper part 331 of stop rail 330, and at the same time, the catcher member 319 contacts the catcher stopper part 333 of stop rail 330. Subsequently, the butt 318 return swings, in the clockwise direction, to its initial position. The impact force arising out of the aforementioned contact is dispersed at two places: the hammer stopper part 331 and the catcher stopper part 333. Therefore, the stability and durability of the overall rotary mechanism are enhanced. When the butt 318 return swings together with the hammer simulation member 320 and the catcher member 319, if the key 311 is released, the rest part 322 of the hammer simulation member 320 contacts the hammer rail part 332 of the stop rail 330.

The third embodiment provides the following effectiveness.

(1) The hammer simulation member 320 is fixed to the butt 318 with the fastener screw 325 through the insertion bore 324, and the butt 318 is received between the butt holding parts 323. Therefore, even after the electronic piano 1 is used over a long period of time, the hammer simulation member 320 is prevented from rotating about the fastener screw 325, and the butt 318 and the hammer simulation member 320 are maintained in a fixed positional relationship. Therefore, the original key touch can be maintained.

(2) The hammer part 321 and the rest part 322 of the hammer simulation member 320 can be easily formed by press working both ends of a metal sheet. Press working is known to be suitable for mass production.

Modifications of the Third Embodiment

Figure 21:
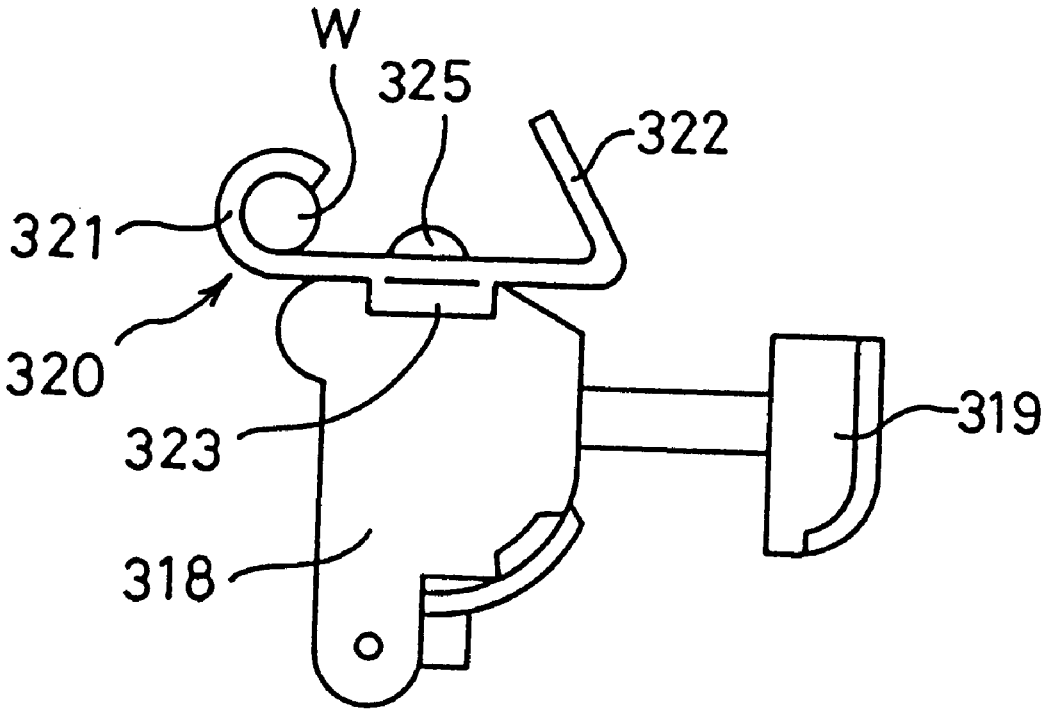
Figure 22:
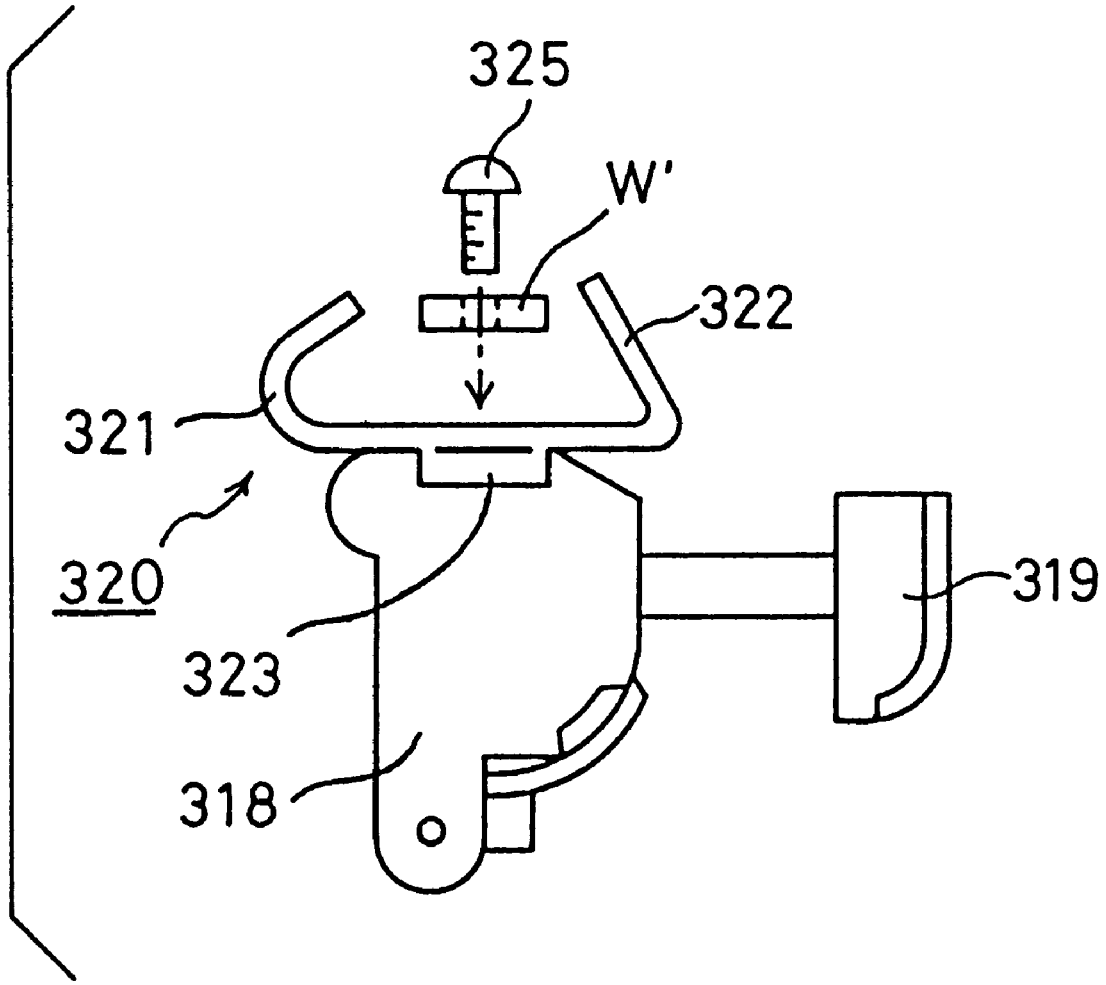
FIG. 22 is a diagrammatical view of an action simulation hammer and a deadweight secured with a fastening screw to the action simulation hammer according to a modification of the third embodiment of the present invention.

As shown in FIG. 21, a deadweight W is attached to the hammer part 321 of hammer simulation member 320, to change the weight and gravity center of the hammer simulation member 320. Alternatively, as shown in FIG. 22, the fastener screw 325 passes through a deadweight W' and then through the insertion bore 324 to fix the hammer simulation member 320 to the hammer butt 318. The weight and the gravity center of the hammer simulation member can thus be easily varied. In an acoustic piano, the weight and gravity center of the hammer assembly varies from one key to the next. In the electronic piano, just by adding the deadweight W or W' as shown in FIGS. 21 and 22, each hammer simulation member 320 can be adjusted to have an appropriate weight and gravity center to provide a similar key touch to that of each corresponding key in an acoustic piano. Alternatively, the deadweight W can be attached to the hammer part 321 and at the same time the deadweight W' can be fixed with the fastener screw 325.

Figure 23:
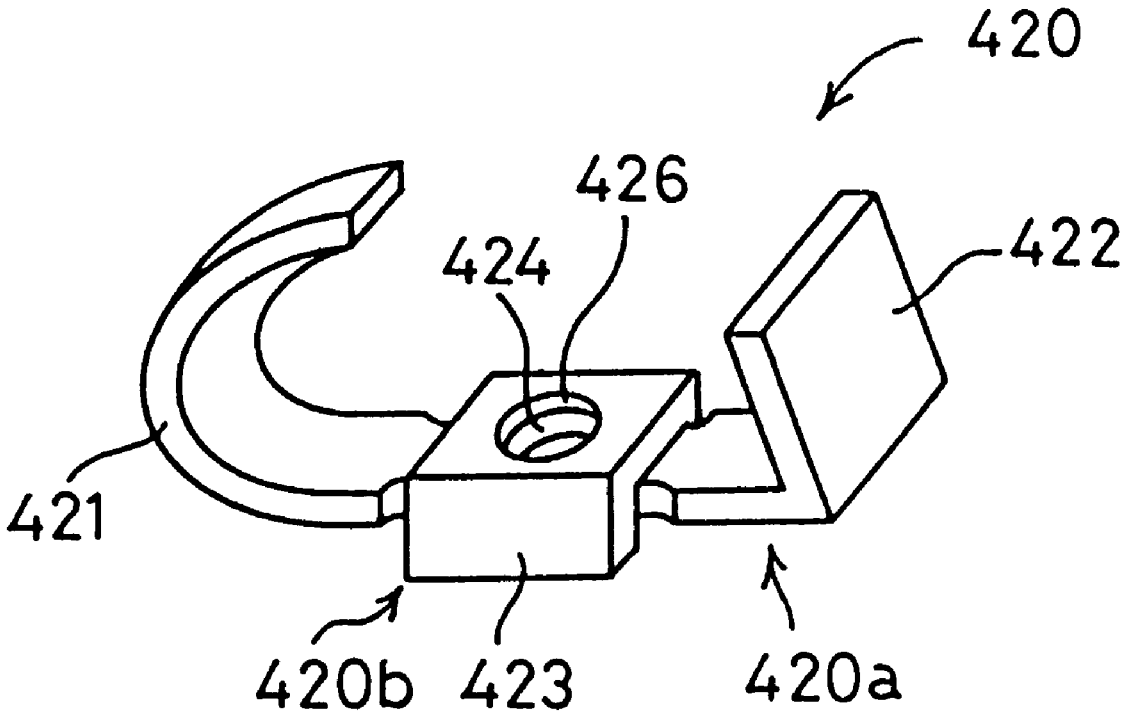
FIG. 23 is a perspective view of an action simulation hammer composed of three components according to a modification of the third embodiment of the present invention.

In the third embodiment, the hammer simulation member 320 is manufactured by press working one metal sheet. However, as shown in FIG. 23, a hammer simulation member 420 can be manufactured by welding separate hammer bodies 420*b* and 420*a* together. A first hammer body 420*a* is formed of a hammer part 421 at one end, a rest part 422 at the other end and an insertion bore 424 provided in about the center of the first hammer body 420*a*, by press working a metal sheet. By press working another metal sheet, a second hammer body 420*b* is formed having a pair of butt holding parts 423 at opposite sides thereof (only one butt holding part 423 is shown in FIG. 23 for simplicity), and an insertion bore 426 provided in about the center of the second hammer body 420*b*.

The adjustment of the let-off timing is now described. In the acoustic piano shown in FIG. 14, the let-off timing, i.e. when the jack 117 disengages from the butt 118, is varied by adjusting the height of the regulating button 116 such that the jack 117 leaves the butt 118 at a position where the distance between the hammer felt 122 and the string is a predetermined value p(mm). To realize an acoustic piano key touch in the electronic piano 1, the distance between the hammer part 321 and the hammer stopper part 331, at the let-off timing, is adjusted to a value p'(mm) based on the predetermined value p(mm) in the acoustic piano. The rotary angle α, through which the hammer part 321 rotates from its initial position until it contacts the hammer stopper part 331, is equal to-the rotary angle β, through which the catcher member 319 rotates from its initial position until it contacts the catcher stopper part 333. Therefore, the distance between the catcher member 319 and the catcher stopper part 333, at the let-off timing, is adjusted to a value p"(mm), based on the aforementioned value p'(mm). Specifically, by turning the screw 342 of the regulating button 316, thereby adjusting the let-off timing to be equal to that of the acoustic piano, the space between the catcher member 319 and the catcher stopper part 333 at the let-off timing is adjusted to the desired value p"(mm).

Figure 18:
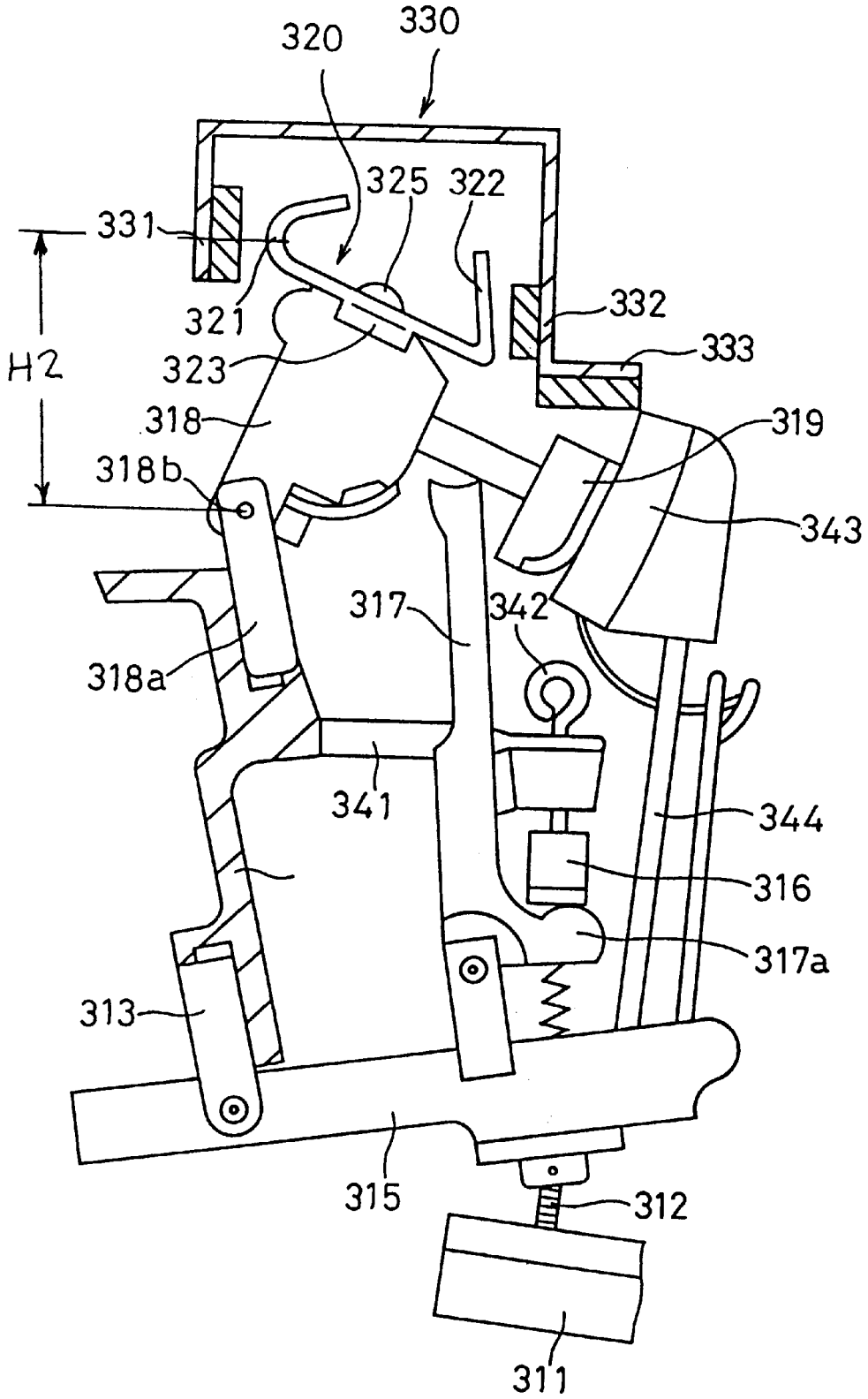
FIG. 18 is a diagrammatical view of a back stop timing of the third embodiment of the action simulation mechanism made in accordance with the present invention.

When the butt 318 return swings together with the hammer simulation member 320 and the catcher member 319, if the key 311 is still depressed, as shown in FIG. 18, the catcher member 319 is received by the back check 343 at a back stop position and at a back stop timing, thereby preventing before the rest part 322 from contacting the hammer rail part 332.

The adjustment of the back stop timing is now described. In the acoustic piano shown in FIG. 14, the back stop position, i.e. when a key 111 is continuously depressed so that a catcher 119 is received by a back check 143 after the hammer felt 122 strikes the string, is adjusted by bending a wire 144 of back check 143. The wire 144 is bent such that the catcher 119 is received by the back check 143 at a position where the distance between the hammer felt 122 and the string is a predetermined value q(mm). To realize an acoustic piano key touch in the electronic piano 1, the distance between the hammer part 321 and the hammer stopper part 331, at the back stop position, is adjusted to be a value q'(mm), based on the predetermined value q(mm) in the acoustic piano. The rotary angle α, through which the hammer part 321 rotates from its initial position until it contacts the hammer stopper part 331, is equal to the rotary angle β, through which the catcher member 319 rotates from its initial position until it contacts the catcher stopper part 333. Therefore, the distance between the catcher member 319 and the catcher stopper part 333, at the back stop position, can be calculated as a value q"(mm), based on the aforementioned value q'(mm). Specifically, by bending the wire 344 of the back check 343, the distance between the catcher member 319 and the catcher stopper part 333, at the back stop position, is adjusted to the calculated value q"(mm), thereby making the back stop timing equal to that of an acoustic piano.

In the action simulation mechanism 300, the hammer simulation member 320 is covered by the stop rail 330, so that it is difficult to measure the interval between the hammer part 321 and the hammer stopper part 331. However, the catcher member 319 projects from the butt 318 toward the front of the electronic piano 1 and is exposed to facilitate measuring the interval between the catcher member 319 and the catcher stopper part 333. Therefore, in the third embodiment, the let-off timing and the back stop timing can be easily adjusted.

Also, in the action simulation mechanism 300, the hammer stopper part 331, the hammer rail part 332 and the catcher stopper part 333 are provided on the stop rail 330, which simplifies the overall structure.

Figure 19:
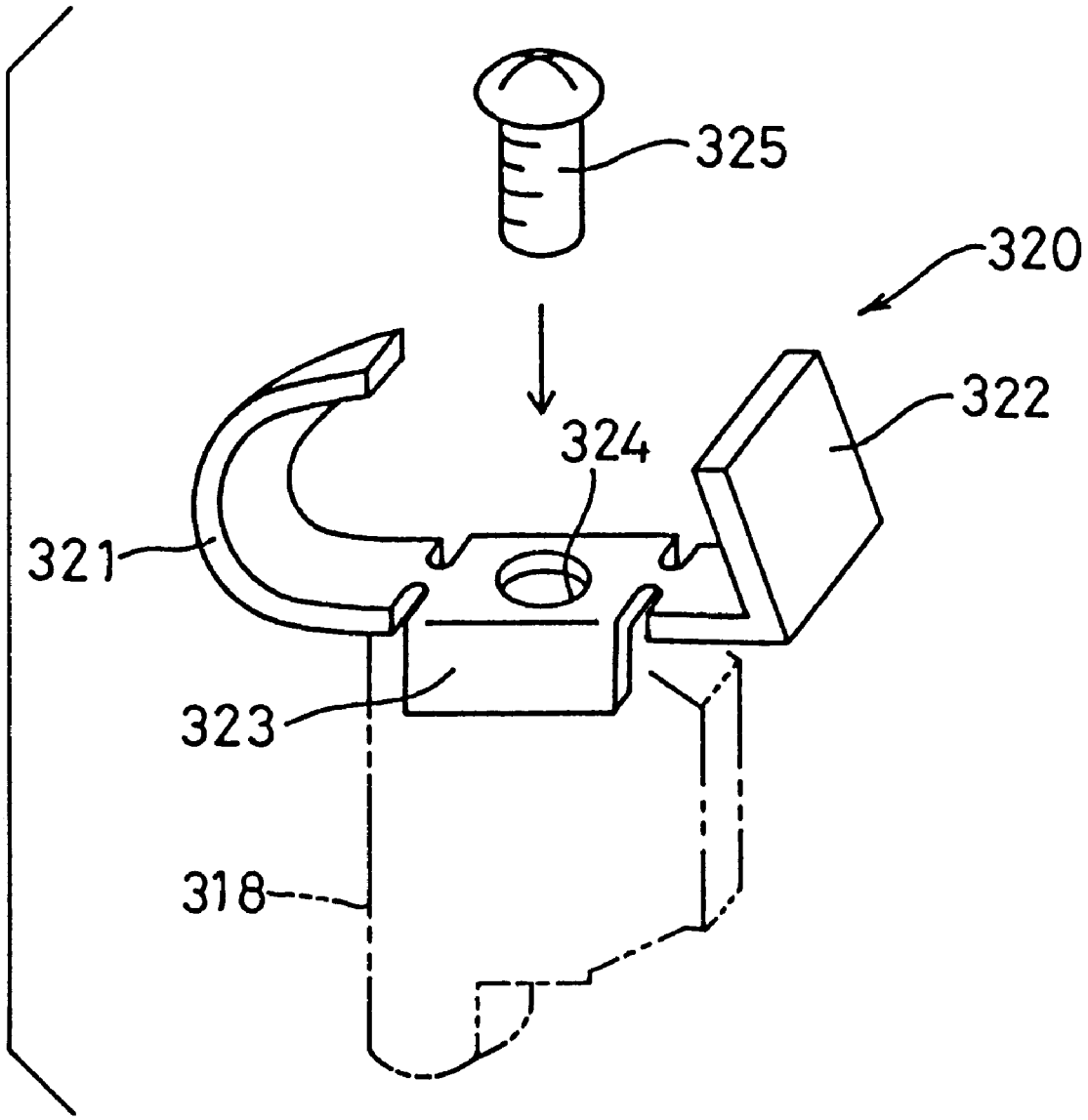
FIG. 19 is a perspective view of an action simulation hammer of the third embodiment of the present invention.
Figure 20A:
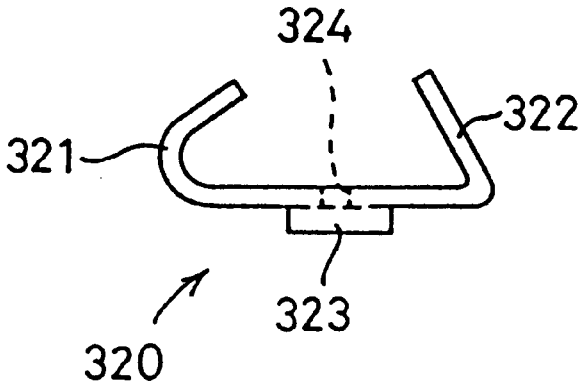
FIGS. 20A and 20B are a front view and a right side view, respectively, of the action simulation hammer of the third embodiment of the present invention.
Figure 20B:
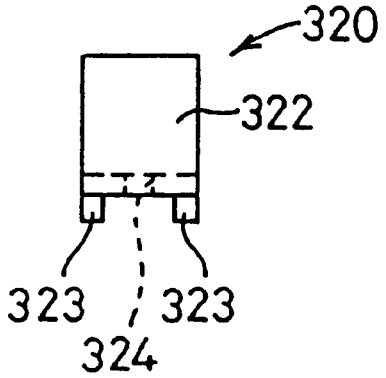

The configuration of the hammer simulation member 320 of the third embodiment is not limited to that shown in FIG. 19. Instead, the hammer simulation member 320 can be U-shaped, L-shaped, or the hammer assembly 120 shown in FIG. 14 of any size.

In the action simulation mechanism 300 of the third embodiment, each regulating button 316 of each jack 317 can be adjusted with the screw 342. The regulating buttons 316 can be replaced by a regulating felt for adjusting the let-off timing of the jacks 317 in the action simulation mechanism 300. Since the let-off timing can be adjusted at once, the adjustment can be facilitated, the number of the components can be reduced and the manufacture cost can also be reduced.

This invention has been described above with reference to the preferred embodiments as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

What is claimed is:

1. A hammer simulation member for use in an action simulation mechanism for applying an action simulating load to a key of an electronic keyboard instrument, said action simulation hammer comprising:

a hammer part for striking a hammer stopper part upon key depression; and a rest part adjacent said hammer part for contacting a hammer rail part after key release;

wherein said hammer simulation member further comprises a pair of opposed butt holding parts interposed between said hammer part and said rest part, and said butt holding parts are spaced apart a distance substantially equal to a width of a butt of an action simulation mechanism and are adapted to receive said butt.

2. A hammer simulation member according to claim 1, wherein said hammer simulation member manufactured from metal.

3. An hammer simulation member according to claim 1, wherein said hammer part is provided with a deadweight.

4. A hammer simulation member according to claim 1, wherein said hammer simulation member further comprises:

an insertion bore provided through said hammer simulation member;

a fastener insertable through said insertion bore for securing said hammer simulation member to said butt; and a dead weight secured to said hammer simulation member by said fastener.

5. A hammer simulation member in combination with an action simulation mechanism for applying an action simulating load to a key in an electronic keyboard instrument, said action simulation hammer comprising:

a hammer part for striking a hammer stopper part upon key depression; and a rest part adjacent said hammer part for contacting a hammer rail part, after key release; and said action simulation mechanism comprises:

a jack operatively connectable to a key such that, when operatively connected, said jack moves in response to key depression;

a butt rotatable about a fixed axis from an initial position to a rotated position, said butt being releasably engageable with said jack such that movement of said jack drives said butt about said fixed axis from said initial position to a release position where said jack disengages from said butt, said release position being interpose between said initial position and said rotated position, and said hammer simulation member is connected to said butt;

a catcher part projection from said butt and rotatable with said butt; and a catcher stopper positioned to limit movement of said catcher part;

wherein, upon rotation of said butt from said initial position to said rotated position, a rotary angle about which said catcher part is rotated is about equal to a rotary angle about which said hammer part is rotated whereby simultaneous contact occurs between said catcher part and said catcher stopper and between said hammer part and said hammer stopper part.

6. A hammer simulation member according to claim 5, wherein said action simulation mechanism further comprises:

a rail member provided to limit movement of said hammer simulation member, said rail member is provided with said hammer stopper part and said hammer rail part, said hammer stopper part opposes said hammer rail part, and both said hammer stopper part and said hammer rail part are positioned in a rotational path of said hammer simulation member to limit rotational movement of said hammer simulation member.

7. A hammer simulation member according to claim 6, wherein said rail member is provided with said catcher stopper.

* * * * *